US005664773A

United States Patent [19]

Sevcik et al.

[11] Patent Number: 5,664,773

[45] Date of Patent: Sep. 9, 1997

[54] STRIP CONVEYOR AND STACKER

[75] Inventors: Thomas E. Sevcik, Thornton; James H. Sealey, Westminster; Joseph E. Kovach, Thornton; Wendell B. Colson, Boulder, all of Colo.

[73] Assignee: Hunter Douglas Inc., Upper Saddle River, N.J.

[21] Appl. No.: 482,629

[22] Filed: Jun. 7, 1995

[51] Int. Cl.[6] ..... B65H 5/02

[52] U.S. Cl. ..... 271/276; 271/197

[58] Field of Search ..... 271/196, 197, 271/276, 309; 198/689.1, 840, 841

[56] References Cited

U.S. PATENT DOCUMENTS

| | | | |
|---|---|---|---|
| 3,642,119 | 2/1972 | Warwick | 198/840 X |
| 3,660,195 | 5/1972 | Hoyt . | |
| 4,412,738 | 11/1983 | Ahern et al. | 271/197 X |
| 4,555,013 | 11/1985 | Franklin | 271/197 X |
| 4,620,826 | 11/1986 | Rubio et al. | 271/197 X |
| 4,643,412 | 2/1987 | Heina et al. | 271/197 X |
| 4,849,039 | 7/1989 | Colson et al. . | |
| 5,139,253 | 8/1992 | Bohme et al. | 271/197 |
| 5,228,936 | 7/1993 | Goodhue . | |
| 5,308,435 | 5/1994 | Ruggles et al. . | |
| 5,313,999 | 5/1994 | Colson et al. . | |

*Primary Examiner*—David H. Bollinger

*Attorney, Agent, or Firm*—Gary M. Polumbus; Dorsey & Whitney LLP

[57] ABSTRACT

A strip conveyor and stacker receives cut elongated flexible strips from a strip former and by conveying and stacking the strips produces a stack of strips such as a cellular panel for a window covering. The conveyor receives the strips from the strip former and includes a foraminous conveyor belt which holds the strips on the surface thereof by suction. At the stacker, the strips are discharged from the conveyor belt by applying a burst of pressurized air, thereby ejecting the strips into a stacker magazine. As the strips are stacked, the magazine is indexed to increase its depth, or a cellular structure formed by the stacked strips is withdrawn from the body of the magazine. An auxiliary magazine may be used to form a preliminary stack of soft, flexible strips prior to stacking in the magazine. A strip defect sensor scans each strip and causes the ejection of defective strips from the apparatus.

19 Claims, 16 Drawing Sheets

STRIP CONVEYOR AND STACKER

BACKGROUND OF THE INVENTION

1. Field Of The Invention

The present invention relates to conveyors for conveying elongated cut strip materials and to stackers for stacking such cut strips. More specifically, the invention relates to apparatus for conveying strip materials, particularly flexible fabric materials, and stacking such strips to form cellular materials such as cellular panels for producing window coverings.

2. Description Of The Prior Art

Cellular panels have been formed by stacking cell forming strips in a variety of ways. U.S. Pat. No. 5,228,936 discloses a method and apparatus for continuously feeding thin, narrow, folded, highly-flexible elongated fabric strips, having an adhesive on one face, to a stacker. Strip stock is folded and cut into discrete strip lengths which are conveyed to a stack. As they are conveyed, the strips are supported only along their lateral edges. The cut strips are removed from the conveyor and inserted into the stack by a push piston type stacker mechanism. The stacked strips are then expanded into a cellular panel.

U.S. Pat. No. 3,660,195 discloses a panel forming apparatus in which continuous sheets are fed to an adhesive applicator which applies a plurality of spaced apart adhesive lines to the sheets, followed by a cutter which cuts the sheets into strips and simultaneously stacks the strips in horizontal stacks. The stacks of strips form cellular honeycomb panels.

U.S. Pat. No. 4,849,039 discloses a method and apparatus for forming a cellular panel by stacking, in a stack support, successive folded, cut strips with adhesive beads applied between each folded edge and the central panel of the next succeeding strip, to form a stack of such strips. A cellular panel is withdrawn from a constriction formed in the bottom of the stack support.

U.S. Pat. No. 5,319,999 describes a vacuum conveyor belt for conveying cut strips or vanes to a panel forming apparatus. The belt includes holes through which a suction is applied to the strips.

OBJECTS OF THE INVENTION

It is the principal object of the present invention to provide an improved apparatus for conveying cut strips having adhesive lines formed thereon while supporting the strips over substantially their entire surface, and stacking such strips into a uniform stack to form a cellular panel.

A further object is to provide an apparatus of the foregoing character which facilitates elimination of defective strips.

Another object of the present invention is to provide an improved apparatus for conveying and stacking cut length strips formed of soft, flexible fabric.

A further object of the present invention is to provide an improved apparatus of the foregoing character for conveying and stacking strips bearing adhesive lines or areas on one surface thereof.

Still another object of the present invention is to provide an improved apparatus of the foregoing character for producing a cellular panel from soft, flexible fabric strips by conveying and stacking said strips into vertically expandable stacks.

Still another object of the present invention is to provide a stacker apparatus including an improved conveyer for supporting soft, flexible cut length strips while conveying the strips from a strip former to the stacker.

Still another object of the present invention is to provide a strip stacker incorporating an improved strip conveying and handling mechanism.

Still another object of the present invention is to provide an improved strip stacker which reduces waste of strips and stacks formed therefrom.

Still a further object of the present invention is to provide a strip stacker apparatus which improves the quality of stacks of strips and thereby of cellular panels formed therefrom.

SUMMARY OF THE INVENTION

The strip conveyor stacker embodying the present invention is adapted for batch or continuous production of stacked, cut length strips formed of folded material to produce a cellular panel finding particular but not necessarily exclusive utility for the manufacture of cellular panels useful as shades for windows and other architectural openings. The apparatus, as shown in the drawings, incorporates a stacker which receives and stacks elongated cell strips to form a cellular panel. The stacker receives the strips from a conveyor which in turn receives cut strips from a strip former and accelerates the cut strips and delivers them to the stacker. In the strip former, a strip or ribbon of material, such as a woven or sheet fabric, is formed into a narrow, elongated folded strip. Adhesive is applied to one face of the folded strip, and the folded strip is cut or severed into lengths, which are fed continuously to the conveyor. Strip formers, which fold the strip from a ribbon and apply an adhesive thereto, are well-known in the art of producing cellular panels from stacked strip elements. A strip length which forms an individual cell unit of such a cellular panel is formed in the strip former as an elongated continuous folded strip. Adhesive is applied to the lower surface of the strip, such as the folded edges, and the strip is cut into lengths and fed to a conveyor. The conveyor picks up the lengths and, holding the strips on a downward facing surface, delivers them to a vertical stacker positioned below the conveyor.

The conveyor embodying the present invention includes a foraminous section conveyor belt which picks up each cut strip and feeds it to the stacker. The conveyor belt is moving at a rate faster than the rate of movement of the continuous strip in the strip forming apparatus, thereby accelerating the cut strip away from the strip former and continuous strip material, and carries the cut strip into the stacker. The conveyor belt suction holds the strip on the side or surface of the strip which is adhesive free, thus avoiding any external contact with the adhesive. As the conveyor belt picks up the strip, the strip is scanned for defects by a strip scanner on the strip former, prior to the rotary cutter, and defective strips are ejected from the apparatus.

For forming acceptable strips into a stack of strips to form a cellular panel, the suction conveyor positions each cut strip length over the stacker magazine, at which point the conveyor suction is broken, thereby releasing the strip from the conveyor. A positive air flow or air burst is provided blowing the strip into the vertical stack magazine to form a stack of cellular strips. Once the strip is directed into the magazine, the positive air charge is terminated and suction reapplied in preparation for the receipt of the next strip.

The position of the strip over the stack is sensed by a sensor which actuates the positive air discharge to push the strip down into the stacking chamber or magazine. A negative pressure or suction may be applied within the magazine housing adjacent the magazine to prevent the strip from bouncing or fluttering as it is placed in the stack. In this manner, a uniform stack of strips is provided.

In the stack magazine, the stack rests on a vertically indexable stacking bar. For every strip that is deposited in the stacking chamber or magazine, the stacking bar is dropped or indexed a predetermined amount, preferably about 15/1000ths of an inch. A stepper motor drives the indexing assembly to index the stacking bar. A strip sensor triggers the index motor which turns a selected number of turns, such as 15 turns for a 15/1000ths of an inch movement of the stacking bar.

When the stack magazine is full, the magazine is lowered by an elevating and lowering mechanism and the stack is removed and transported to a curing oven for curing the adhesive bonds between the stacked strips. To form a continuous stack, an appropriate stacking channel can be utilized for receiving the cut cell strips and continuously withdrawing the stack from the apparatus. In such a configuration, the apparatus would include a juxtaposed curing chamber for setting the adhesive.

For forming cellular panels of soft, flexible fabric material, strip cell sections are formed from the material by starting with a narrow strip, folding the edges inwardly, and applying adhesive beads along the inturned edges. Such a strip is then cut into lengths and the strip segments are stacked one on top of the other. The adhesive beads bond each strip to a succeeding strip. When the bonded stack of strips is expanded, a cellular panel is produced. Such cellular panels find substantial but not exclusive utility in the formation of vertical window coverings.

Because a wide variety of materials can be utilized for forming the cellular structure, cellular strip conveying and stacking apparatus must be able to handle a variety of such materials. Problems particularly arise when the materials are of a soft, flexible fabric nature so that the strips require substantial support not only during the adhesive application, but also during transport of strip segments from the strip former and adhesive applier to a stacker.

Accordingly, another embodiment of the present invention which finds particular but not exclusive utility for stacking soft flexible strips incorporates a preliminary or auxiliary stacker magazine which receives a limited number of strips from the conveyor and forms an initial stack which is then discharged into a magazine in which the preliminary stack of strips becomes a part of a larger stack which upon curing forms a cellular panel. The stacker magazine includes a pair of spaced apart metal plates forming a discharge gate. When the shuttle plates are moved towards each other, the discharge gate is closed and the auxiliary magazine can receive a preliminary stack of strips from the conveyor. Upon opening the discharge gate, the strips are discharged into a magazine formed between two magazine plates or walls at the bottom of which is an orifice through which a completed cellular panel can be continuously withdrawn. Heaters are provided on the magazine plates for effecting a cure of the adhesive used to bond the strips while exhaust fans draw a vacuum on the magazine to pull the strips into the magazine and eliminate flutter and wrinkling. Further, the fans can cool the cellular panel as it is formed and cured. The cellular panel is continuously withdrawn through the strip orifice in the bottom of the magazine by a pair of rollers receiving the panel in the nip thereof.

It will be appreciated that various combinations of the mechanisms may be utilized thereby providing for the formation of a wide variety of cellular panels using a variety of materials.

DESCRIPTION OF THE PREFERRED EMBODIMENT

Figure 2:
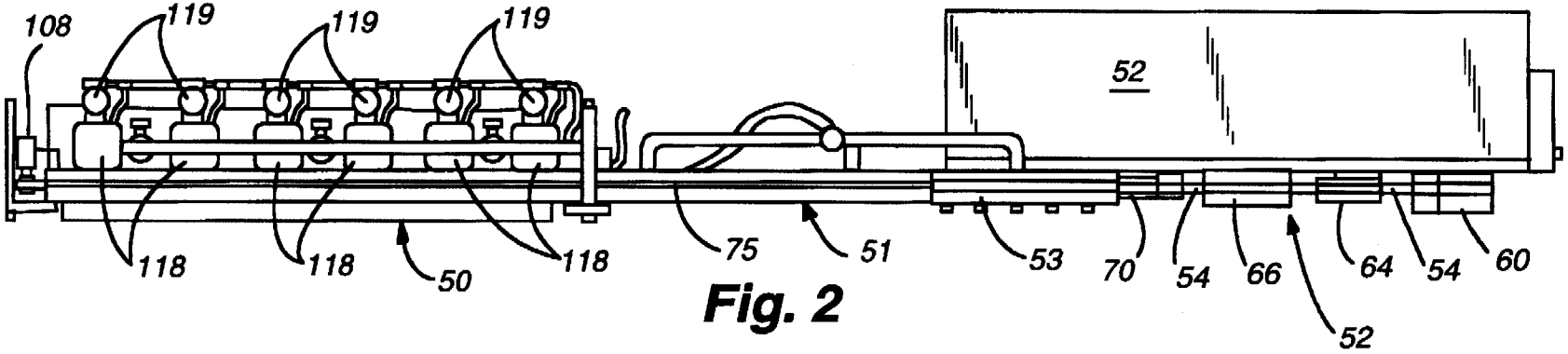
FIG. 2 is a top plan view of the strip stacker shown in FIG. 1.

A conveyor and stacker apparatus embodying the present invention is shown in the drawings in combination with a partly known cell-strip former. In this combination, a stacker 50 receives cell strips from a pneumatic conveyor 51 after the strips are formed by a strip former 52. The operation of the apparatus is controlled at a control center 53 which includes appropriate internal circuits and a front control panel.

Figure 1:
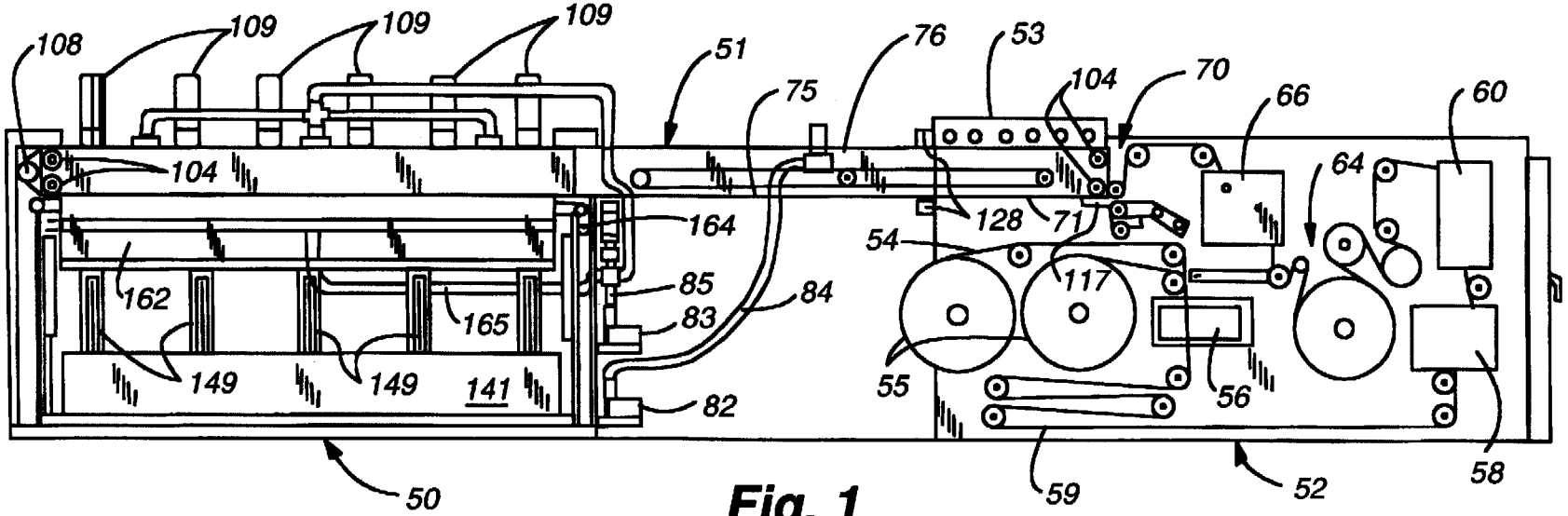
FIG. 1 is a front elevational view of the strip stacker embodying the present invention.

In the strip former 52, as shown in FIG. 1, strip material or ribbon 54 such as soft, flexible fabric material, is supplied on spools 55. Strip material 54 from a single spool 55 is utilized and when that spool is exhausted, strip from a second spool 55 is spliced to the first strip in a splicer 56 and the first spool replenished. The strip 54 is pulled from the supply reel 55 and splicer 56 by a folder feed mechanism 58 through a tensioning system 59 and fed to a folder 60. In the folder, the lateral edges 61 of the strip or ribbon 54 are folded or inturned downwardly to underlie a central base panel 62 of the strip 54 (See FIG. 17). A crease former 64 permanently forms creased edges 65 on the strip 54.

Figure 17:
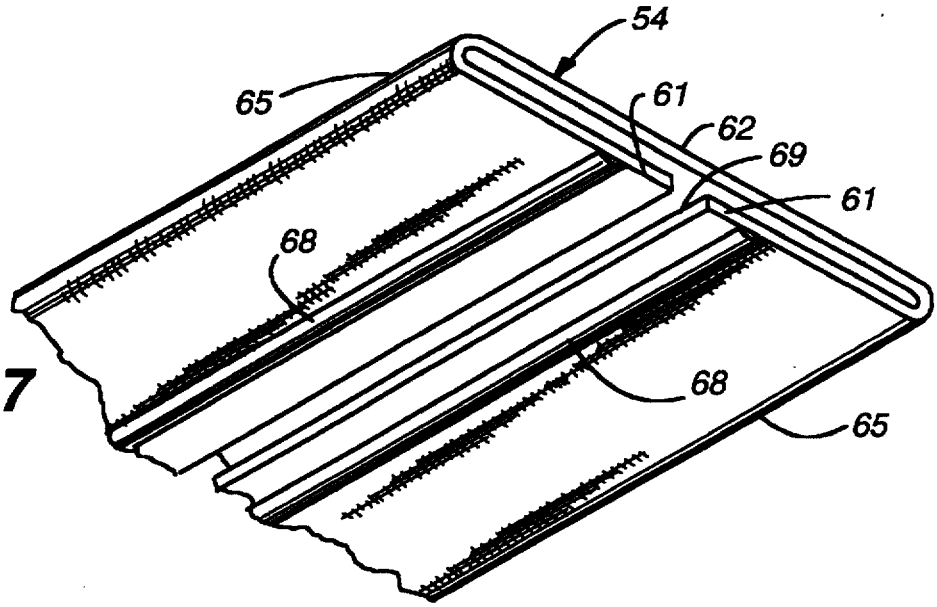
FIG. 17 is an isometric view of a portion of a folded strip of a type stacked in the strip stacker shown in FIG. 1.

For applying adhesive to the external surfaces of the inturned edge panels 61 of the strip 54, the continuous folded strip is fed to an adhesive applicator 66 which applies a bead of adhesive 68 to the exposed surface of each of the inturned panels 61 of the strip 54 adjacent the inturned edges 69 thereof (FIG. 17). Alternatively, the strips may be inverted with the inturned edges directed upwardly. The adhesive beads are then applied to the surface of the central base panel.

Figure 18:
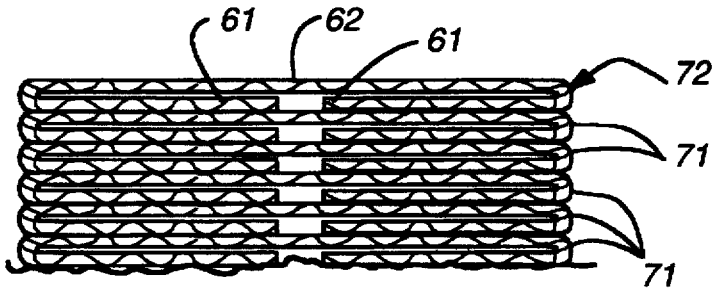
FIG. 18 is an end elevation view of a portion of a stack of strips shown in FIG. 17.
Figure 19:
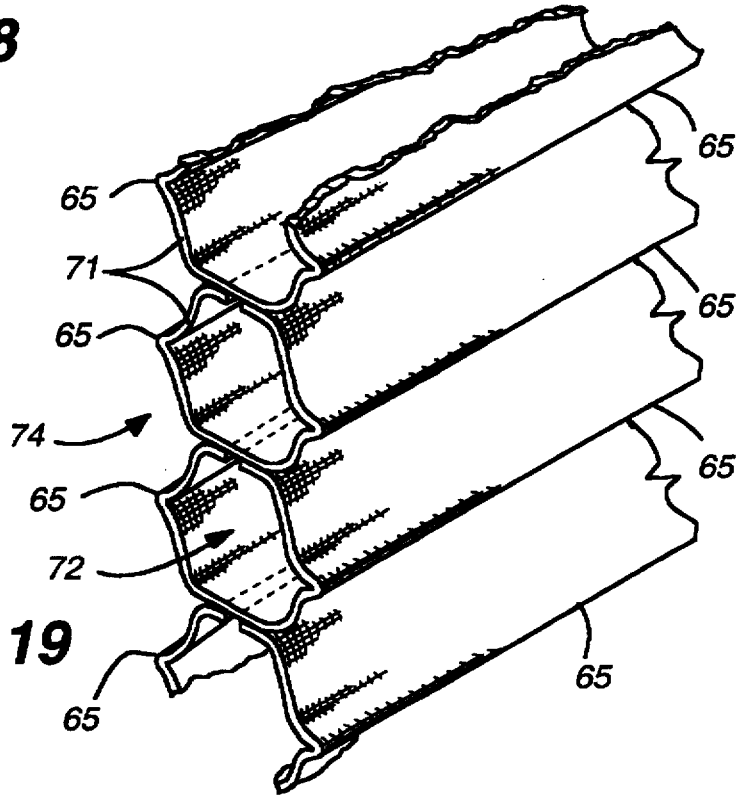
FIG. 19 is an isometric view of a portion of a cellular panel produced from the stack of strips shown in FIG. 18.

From the adhesive applicator 66, the continuous strip 54 with adhesive beads 68 on the downwardly facing surface thereof is fed to a feed roller and cutter mechanism 70 which cuts the strip 54 into discrete elongated cell panel strips or lengths 71 and feeds the cut lengths 71 to the conveyor 51 which, in turn, conveys the cut lengths 71 to the stacker 50. An optical scanner or sensor 127 mounted on the strip former 52 or conveyor frame adjacent the cutter and feed roller mechanism 70 scans the cut strips for defects such as splices, tears, slubs, and the like, and signals a control circuit to reject defective strips so that rejected strips are not inserted into the stacker 50 from which they would appear in and thus damage the final product. In this manner, the strip former 52 takes the feed strip or ribbon 54 and, by folding, creasing, and application of adhesive, converts the strip material to discrete length elongated strip or cell sections 71 suitable for stacking into a stack 72 (FIG. 18) to form, when expanded, a cellular panel 74 formed of uniform, defect-free strips 71 and defining a plurality of connected cells 73 (FIG. 19).

From the strip former 52, the cut length cell strips 71 are scanned by the defect scanner 127 and transported to the stacker 50. For picking up and conveying the cut folded strips 71 from the strip former 52 to the stacker 50, the present invention embodies an improved strip conveyor 51. The conveyor 51 is a pneumatic or suction conveyor which receives the cut strips 71 from the strip former 52 onto a moving foraminous conveyor belt 75. The belt 75 holds the cut strips 71 by suction or vacuum on a bottom face thereof and conveys the cut strips 71 into the stacker 50 where the conveyor belt drops or ejects successive strips 71. The belt 75 is of a width approximately the width of the strip being conveyed, and is of a thickness and flexibility such that the belt rides easily around appropriate drive and idler pulleys 104 journaled on the conveyor frame 76.

Figure 7:
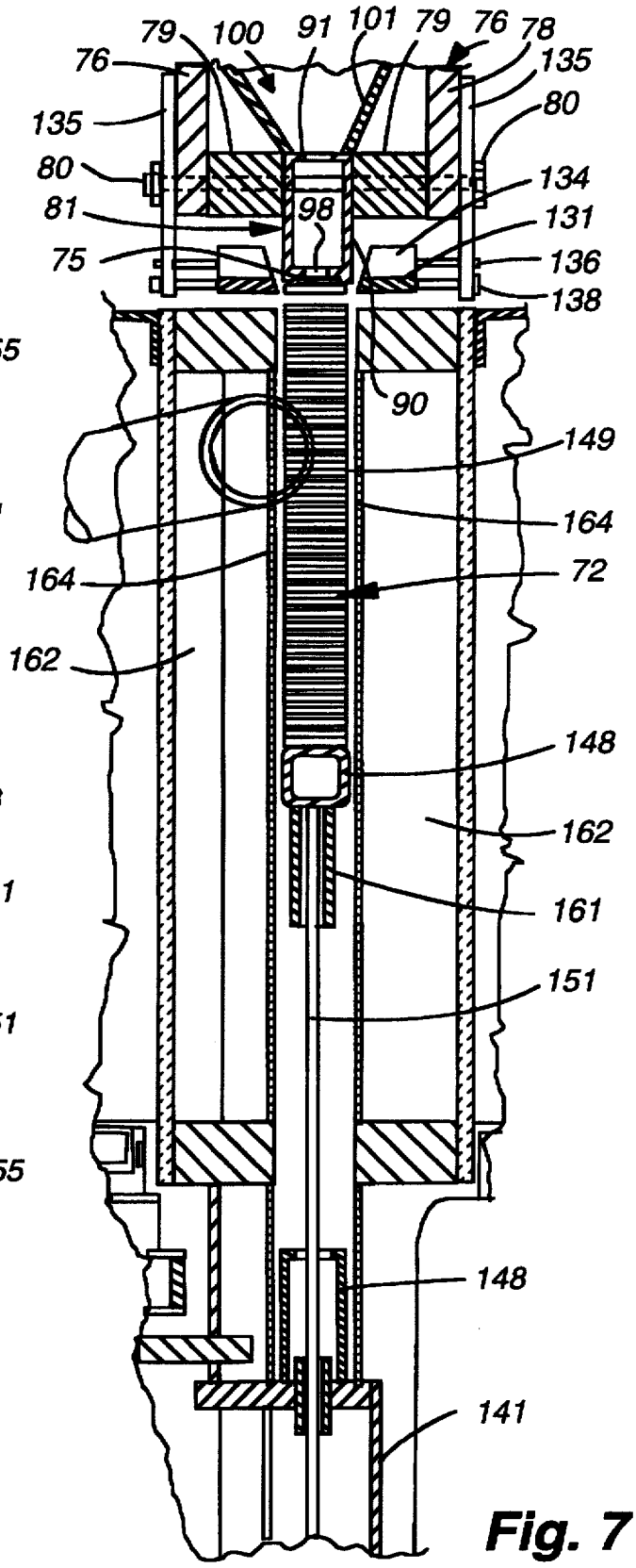
FIG. 7 is a cross-sectional view taken substantially in the plane of line 7—7 on FIG. 3.
Figure 9:
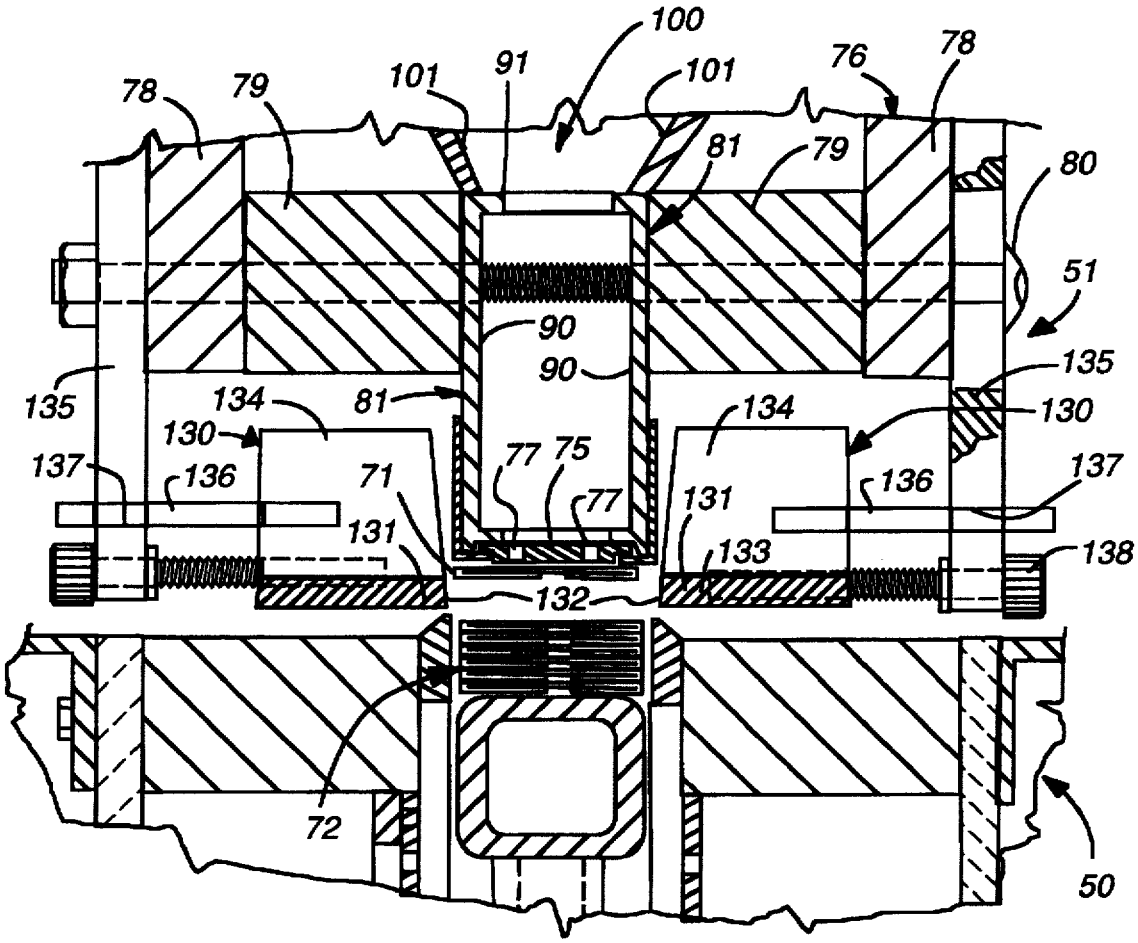
FIG. 9 is a cross-sectional view taken substantially in the plane of line 9—9 on FIG. 6.
Figure 12:
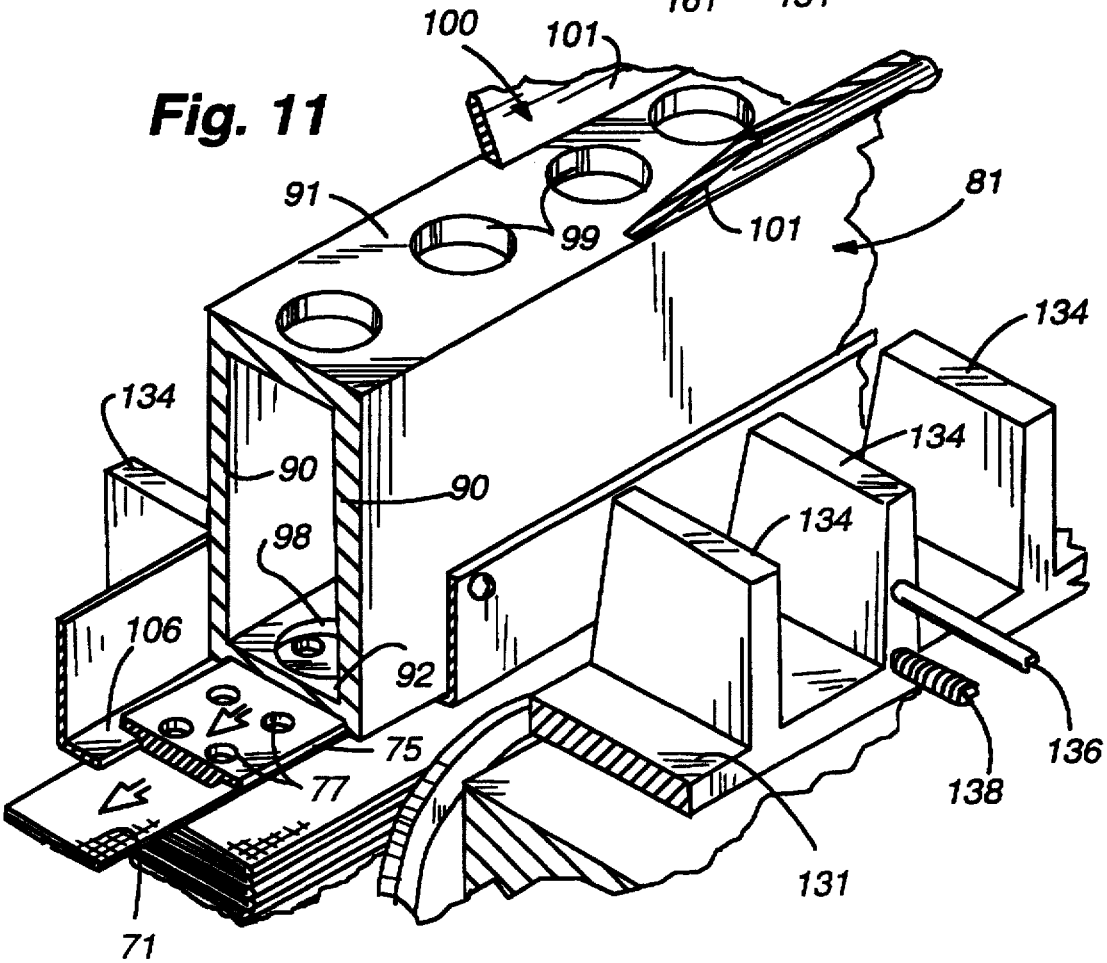
FIG. 12 is an enlarged isometric view of a portion of the strip stacker shown in FIG. 9.
Figure 13:
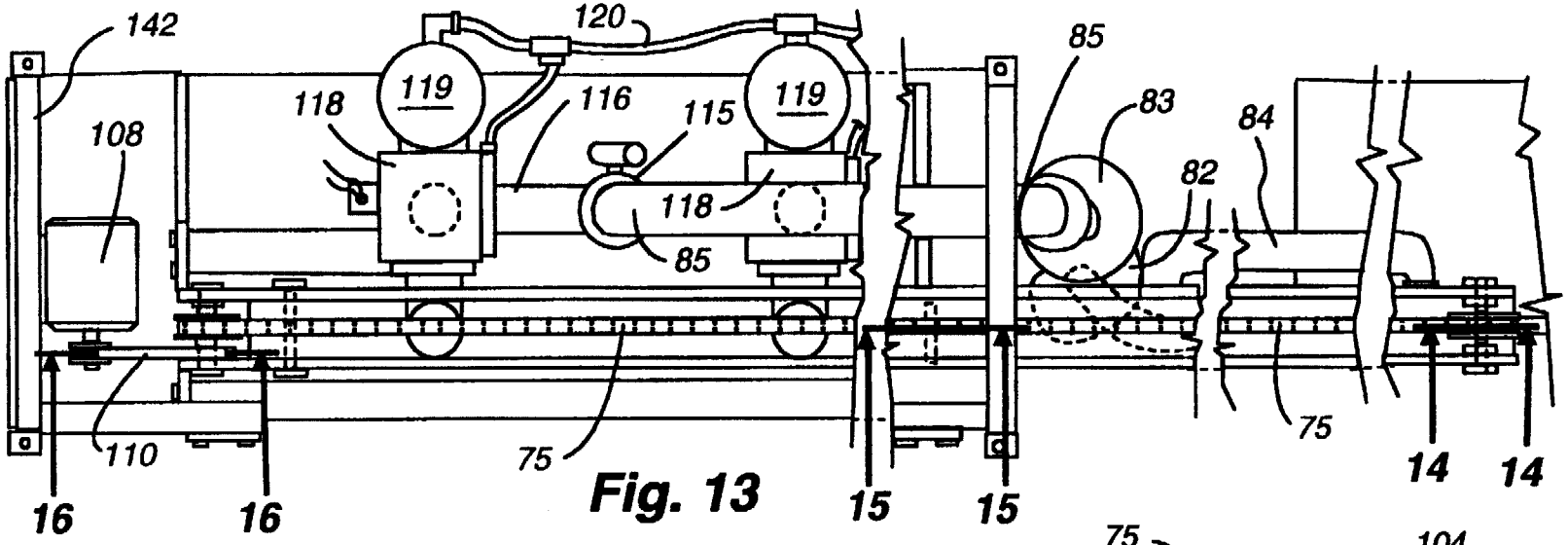
FIG. 13 is an enlarged partial top plan view of the strip stacker shown in FIG. 1.
Figure 14:
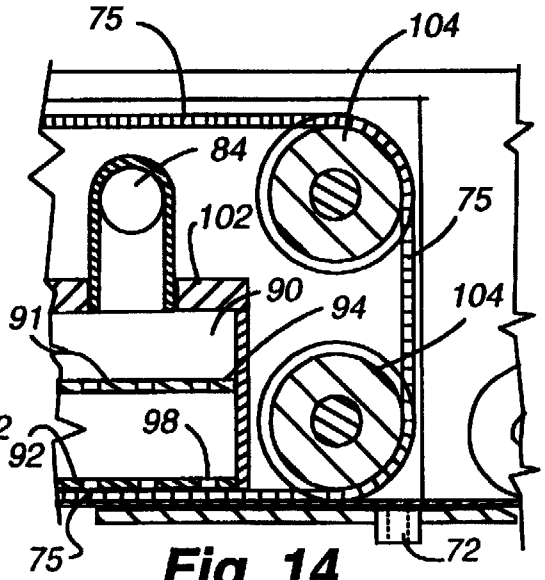
FIG. 14 is a cross-section view taken substantially in the plane of line 14—14 on FIG. 13.
Figure 15:
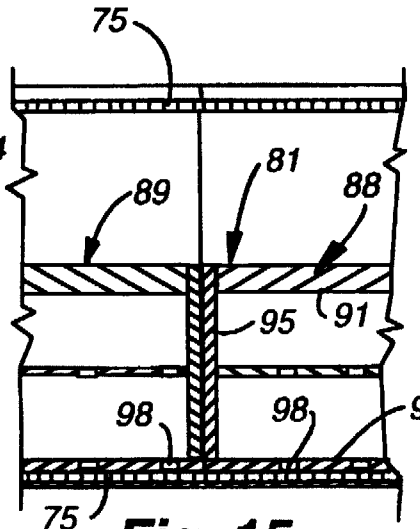
FIG. 15 is a cross-sectional view taken substantially in the plane of line 15—15 on FIG. 13.
Figure 16:
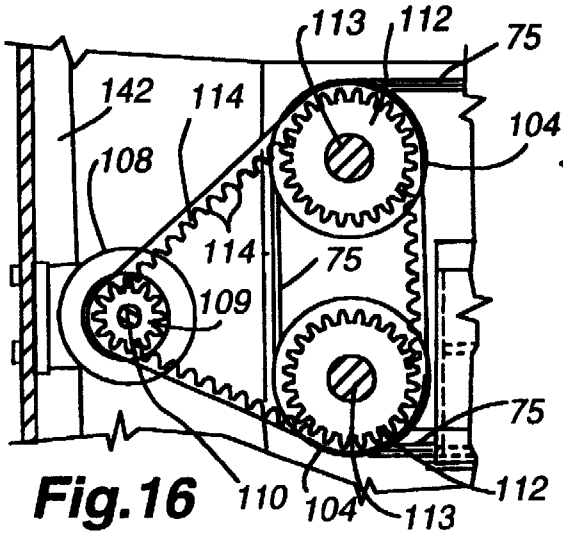
FIG. 16 is a cross-sectional view taken substantially in the plane of line 16—16 on FIG. 13.

To retain and transport the folded strips 71, the conveyor belt 75, as shown in FIGS. 7 and 12, is supported in the conveyor assembly 51 and a suction is applied thereto from above the belt to hold the strips on the bottom or outer face of belt 75. To this end, as shown in FIG. 9, the endless belt 75 is mounted on an elongated frame 76 formed by a pair of spaced apart wall panels 78 each having a base beam 79 extending therealong and secured to the conveyor housing by carriage bolts 80. The conveyor frame 76 is in turn supported on and between the stacker 50 and the strip former 52.

The conveyor belt 75 is foraminous, including or defining a plurality of apertures, foramina, or perforations 77 therethrough, for applying suction to the folded strip 71 to retain the folded strip on the bottom or outer face of the belt 75. The belt 75 is formed of any suitable flexible foraminous material.

For applying suction to the belt 75, a vacuum or suction box or manifold 81 is mounted between the base beams 79 and is connected to vacuum pumps 82, 83 by conduits 84, 85, respectively. The suction box 81 defines two chambers, a first or front chamber 88 and a second or rear chamber 89, each of which chambers are connected to a separate suction or vacuum pump 82, 83, respectively. The suction box or manifold 81 is formed by spaced apart opposed side walls 90, a top wall 91, a bottom wall 92, and end walls 94, with an intermediate wall or bulkhead 95 which divides the suction box into the first chamber 88 and the second chamber 89. The bottom wall of the box 81 is grooved or recessed to define a conveyor belt guide track or channel 96. For applying suction to the belt 75 as it slides along the housing track 96, the top and bottom manifold walls include enlarged lower and upper openings 98, 99, which communicate with a suction chamber 100. The chamber 100 is formed above the manifold 81 between the frame wall panels 78 by upwardly sloping side wall panels 101 joined at their upper edges by a top panel 102 to which the vacuum conduits 84, 85 are connected by appropriate valving and additional conduits.

Figure 3:
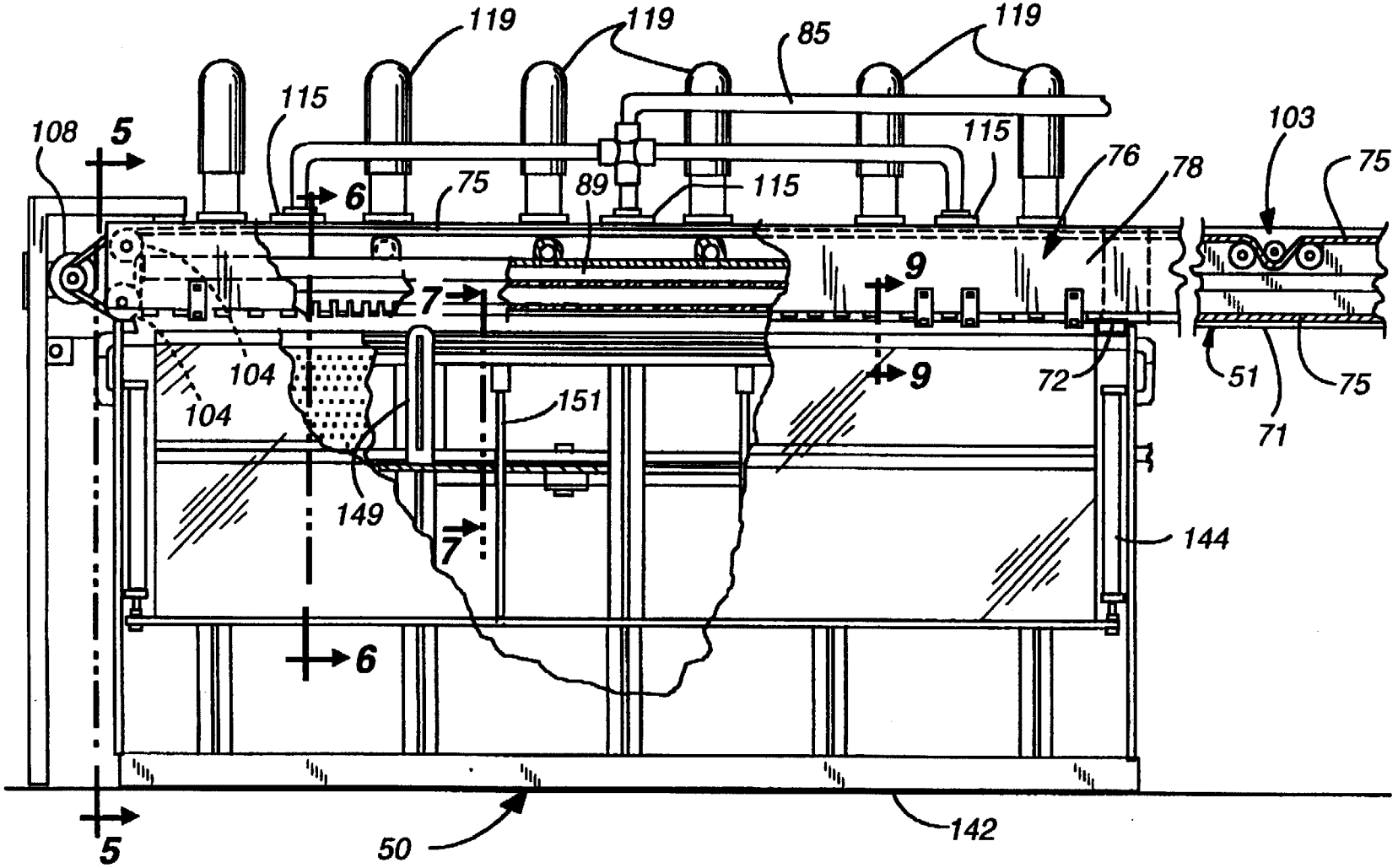
FIG. 3 is an enlarged partial front elevational view of the strip stacker shown in FIG. 1 with parts broken away for clarity.
Figure 4:
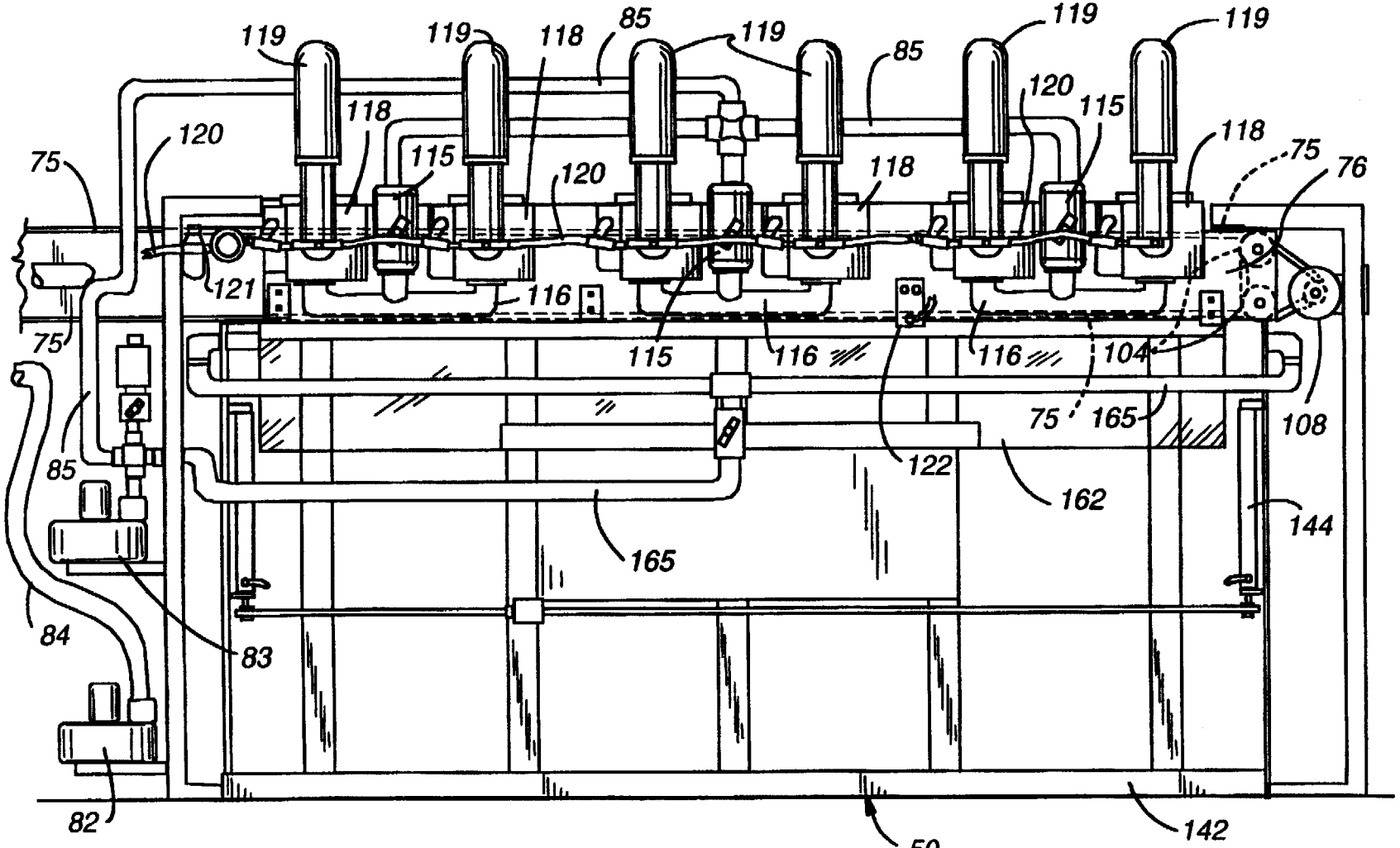
FIG. 4 is a rear elevational view of the strip stacker shown in FIG. 3.

The conveyor belt 75 is trained around pulleys 104 on the conveyor frame 76 and slides or rides in the track, groove or channel 96 defined in the bottom wall 92 of the suction manifold 81. One or more pulleys 104 are provided at each end of the frame 76. At one end of the conveyor, the rollers or pulleys 104 constitute idler pulleys, with drive pulleys 104 provided at the other end. For adjusting and maintaining belt tension at the desired level, a belt tensioning mechanism 103 is provided on the return or upper level of the belt (FIG. 3).

Figure 8:
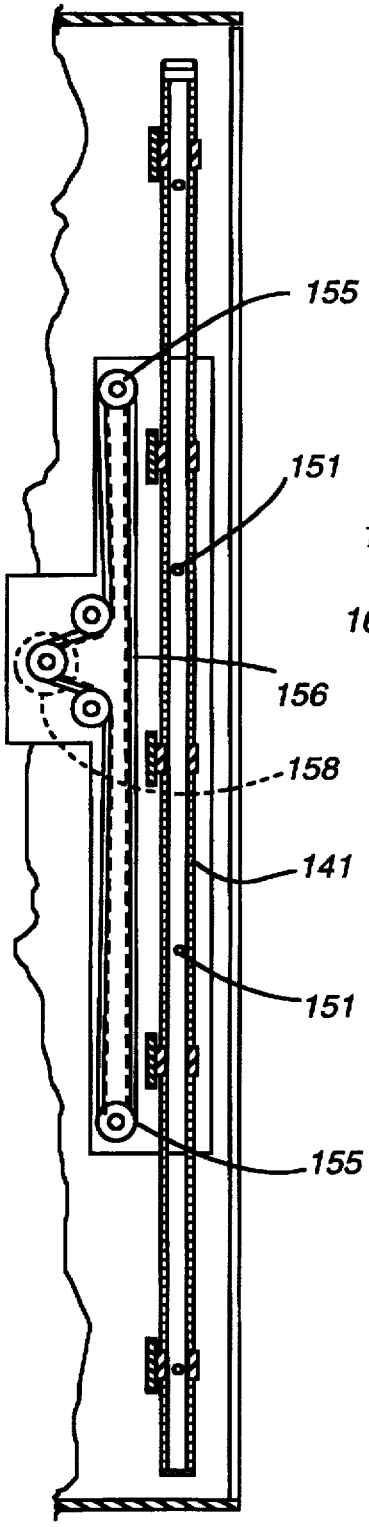
FIG. 8 is a cross-sectional view taken substantially in the plane of line 8—8 on FIG. 6.
Figure 10:
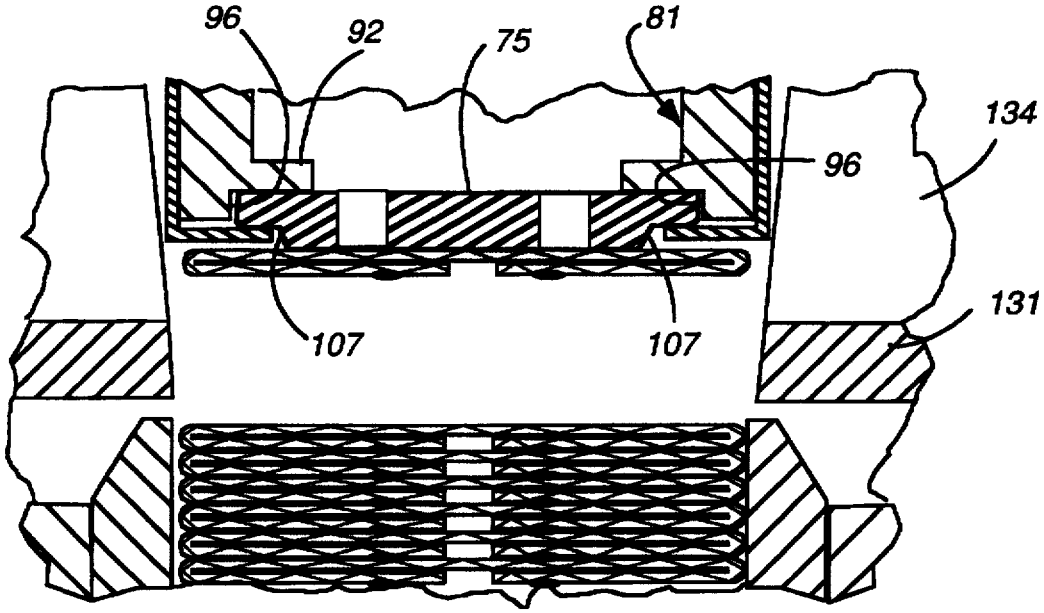
FIG. 10 is an enlarged cross-sectional view of a portion of the mechanism shown in FIG. 9.
Figure 11:
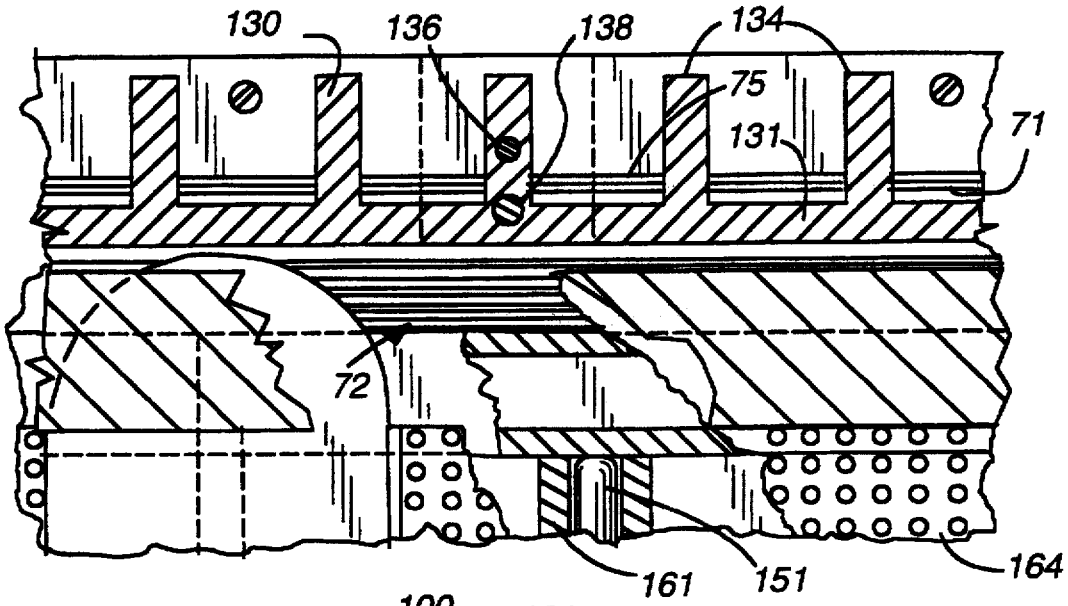
FIG. 11 is a cross-sectional view taken substantially in the plane of line 11—11 on FIG. 9.

The conveyor belt 75 is retained or captured in the track 96 by a guide plate or bracket 105 mounted on the manifold and having an inturned lower edge or lip 106 (FIGS. 8, 9). The guide plate 105 is secured to the manifold 81 with the inturned lower edge 106 extending below the recessed track defined in the bottom wall 92. The conveyor belt 75 is formed with a groove or recess 107 along each of its lateral edges for receiving the guide plate lips, with the central foraminous section of the belt extending outwardly between the guide plate lips 106 for receiving and retaining a strip 71 (FIG. 10).

For driving the conveyor belt 75, a belt drive motor 108 is mounted on the conveyor frame support and operatively engages the drive pulleys 104 at the discharge end of the conveyor. Driving engagement is provided by a sprocket 109 on the output shaft 110 of the belt drive motor 108 which is drivingly engaged with a drive belt 111 engaging sprockets 112 on the shaft 113 supporting each conveyor drive pulley 104. The drive belt 111 includes teeth 114 on its inner surface which engage with the sprockets 109, 112 to drive the conveyor pulleys 104. While two pulleys 104 have been shown at each end of the conveyor frame, one larger diameter pulley could optionally be utilized at each or either end.

To provide for pickup of the folded strips 71 from the cutting and feed rollers of the strip former 52, and acceleration of each cut strip away from the next succeeding strip, the conveyor 75 is driven at a greater linear speed than the speed of the feed rollers. Before cutting or severing the folded strip into cut lengths, the leading portion of the strip slides with respect to the conveyor belt. When cut and severed to form a discrete elongated strip section, the cut strip is grabbed by the conveyor belt suction and carried by the conveyor belt 75 at uniform speed rapidly away from the feed rollers and cutter into the strip stacker 50.

The first suction chamber 88 applies suction, produced by a vacuum pump 82, to the belt 75 sufficient to retain the cut strip 71 thereon and carry the strip 71 to the second suction chamber 89 where the strip 71 is positioned above the stacker 50.

To detect defects, splices, slubs, and the like, the cut strip 71 is scanned by a defect scanner 127 on the strip former prior to the rotary cutter. This defect sensor 127 scans the strip and, if a defect is noted, the sensor activates a discharge circuit and mechanism to eject a defective cut strip from the apparatus. When the defect scanner senses a defect, it causes the inactivation of the stacker and the strip with the defect by-passes the stacker and is ejected at the stacker end of the apparatus and discarded.

For discharging static electricity generated by the moving suction conveyor belt 75, one or more static discharge elements 128 are provided in association with the conveyor belt 75. The static discharge element is preferably located at the entrance to the stacker 50.

At the end of the conveyor 51 overlying the stacker 50, suction is applied to the conveyor belt 75 by a vacuum pump 83 through a vacuum conduit 85 connected to a plurality of on-off control valves 115. The control valves 115 in turn open through branch conduits 116 through three-way valves 118 and conduits 117 connecting the valves 118 to the second suction chamber 89 of the suction or vacuum manifold 81. As the cut strip 71 approaches the discharge end of the conveyor belt 75, the cut strip 71 is released from the conveyor belt and directed into the stacker 50. The strip release is accomplished by applying a surge or pulse of air to the second suction manifold chamber 89, which results in the application of a pulse or burst of air to the foraminous conveyor belt 75. The air pulse overrides the vacuum in the suction chamber and releases or pushes the strip away from the conveyor belt 75 and directs it downwardly into the stacker.

For purposes of applying an air pressure burst or pulse to the suction manifold 81 and conveyor belt 75, a plurality of air accumulators 119 receive compressed air from a compressed air supply line 120 which includes an air control valve 121. The air accumulators 119 are mounted on the conveyor frame 76 and are connected to the suction manifold chamber 89 through conduits 123 leading to the three-way valves 118 and conduits 117. These valves 118 thus supply to the conveyor manifold chamber 89 either vacuum from the vacuum source 83 or compressed air as a pulse from the accumulator 119. When a cut strip 71 reaches the discharge end of the conveyor 75, a sensor 122 mounted on the conveyor frame adjacent to the belt 75 detects a predetermined end edge of the strip 71 carried on the belt 75, either the trailing or the leading edge, and preferably the former to enable the stacking of various lengths of cut strip, and actuates each three-way valve 118 simultaneously to apply a burst of air to the chamber 89 of the conveyor suction belt manifold 81. This burst of air overcomes the vacuum in the second manifold chamber 89 for an instant and forces or pushes the cut strip 71 off of the conveyor belt 75 downwardly into the stacker 50. As the strip is discharged, the three-way valves 118 again shift to open the vacuum conduit 116 allowing the vacuum pump 83 to pull a vacuum in the conveyor manifold chamber 89, and close the conduits 123 to the accumulators so that compressed air accumulates in the air accumulators 119 for subsequently discharging a succeeding cut strip 71.

As the cut strip 71 is discharged from the conveyor belt 75 into the stacker 50, it is guided onto the top of the stack 72 by spaced guides 130 on each side of the conveyor 75 (FIG. 9). The guides 30 are formed by elongated, laterally extending plates 131 having inner guide edges 132 sloping downwardly and inwardly to define a guide lip or edge 133 (FIG. 9). The guide plates 131 are supported by integral or affixed buttresses 134 which are in turn supported on the conveyor frame housing by strip guide support brackets or plates 135. The support plates 135 slidingly support guide pins 136 projecting outwardly from the guides 130 through corresponding apertures 137 in the plates 135. The support plates 135 for the strip guide 130 include position adjusting screws 138 journaled on the strip guide plates 135 and threadably engaged with the guide plates 131 and buttresses 134 for adjustably positioning the guide plates 131 adjacent the discharge conveyor for guiding the strips into a magazine 140 in the strip stacker 50. While the guide plates 131 are shown in the drawings as supported on the conveyor housing by the brackets 135, they could be mounted on the stacker 50.

Figure 20:
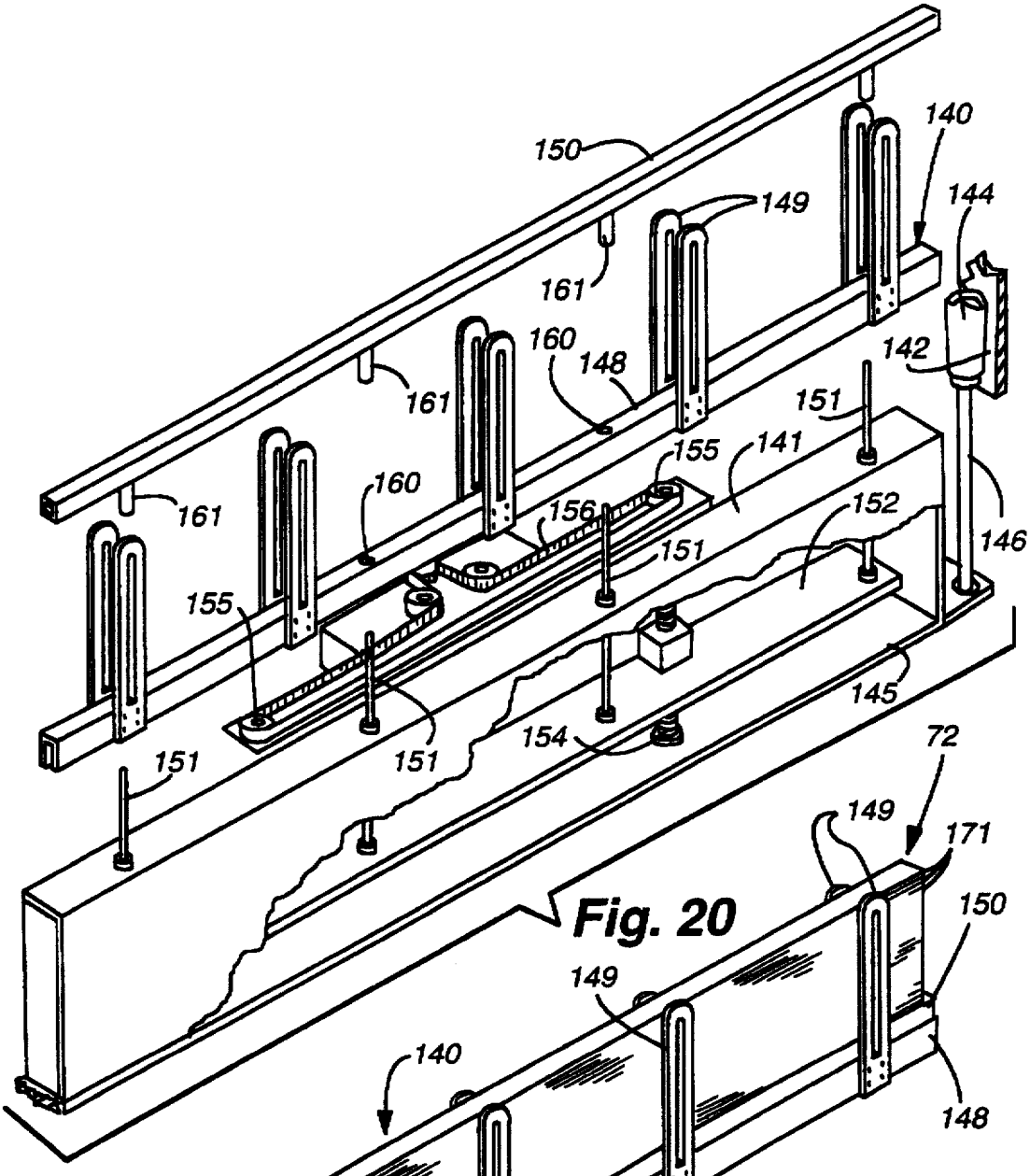
FIG. 20 is an enlarged isometric view, with parts cut away for clarity of a strip stack receiving portion of the strip stacker shown in FIG. 1.

For receiving cut strips 75 and stacking them into a stack 72 suitable for forming a cellular panel 74, the stacker 50 embodies a stack magazine 140 formed by an elongated, rectangular support housing 141 (FIG. 20). The housing 141 is adjustably mounted on a stacker frame base 142 by a vertically adjustable piston and cylinder elevating motor 144. The magazine housing 141 is formed by a base plate 145 secured to one end of a pair of piston rods 146, extending from vertical adjusting piston and cylinder motors 144 mounted on the frame base 142. The piston rods 146, when actuated, raise or lower the magazine housing 141 thereby to position the magazine 140 for receiving strips 71 or, when full, for removal of a stack 72 of strips 71.

As shown in FIG. 20, the magazine 140 is formed by an elongated solid or tubular base beam 148 having a plurality of spaced guide fingers 149 extending vertically upwardly from each lateral side of the base beam 148. Each finger 149 is paired with an opposite finger. The fingers are rounded at their upper ends and may be slightly flared at their tips to facilitate receipt of stacked strips. For receiving and supporting stacked cut strips 71, an elongated rigid stack bar 150 is mounted on the base between the pairs of fingers 149. The stack beam 148, together with the bar 150 and stack 72 of strips 71 can be readily removed as a unit from the stacker 50. The stack bar 150 is vertically adjustable over the base beam 148 between the guide fingers 149. For this purpose, the stack bar 150 is removably mounted on a plurality of adjusting or index rods 151 secured to and extending upwardly from an index rod support plate 152 adjustably housed within the support housing 141.

The index rod support plate 152 is vertically adjustably mounted within the housing 141 by a pair of spaced adjusting indexing screws 154 journaled on the magazine base plate 145 and having sprockets 155 at their upper ends connected to a toothed indexing belt or chain 156 driven by an index motor 158. For raising or lowering the stack bar 150, the indexing screws 154 are threadably engaged with index nuts 159 secured to the index rod support plate 152. For receiving the upper ends of the index rods 151, which extend upwardly from the support plate 152 through the top wall of the housing 141 and through apertures 160 in the magazine base bar 148, the magazine stack bar 150 is provided with depending sleeves 161 into which the rods 151 are inserted. The magazine base beam 148 is supported on top of the magazine housing 141 and may be removed therefrom when loaded with a stack 72 of strips 71 to facilitate removal thereof from the magazine.

Figure 5:
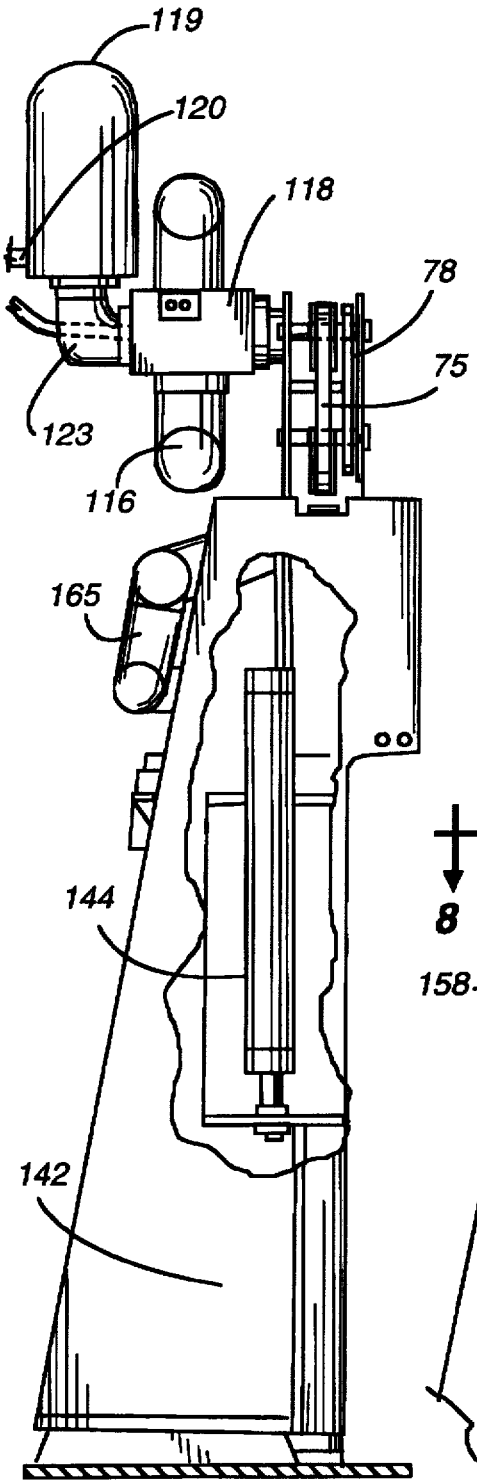
FIG. 5 is an end elevational view of the strip stacker shown in FIG. 3.
Figure 6:
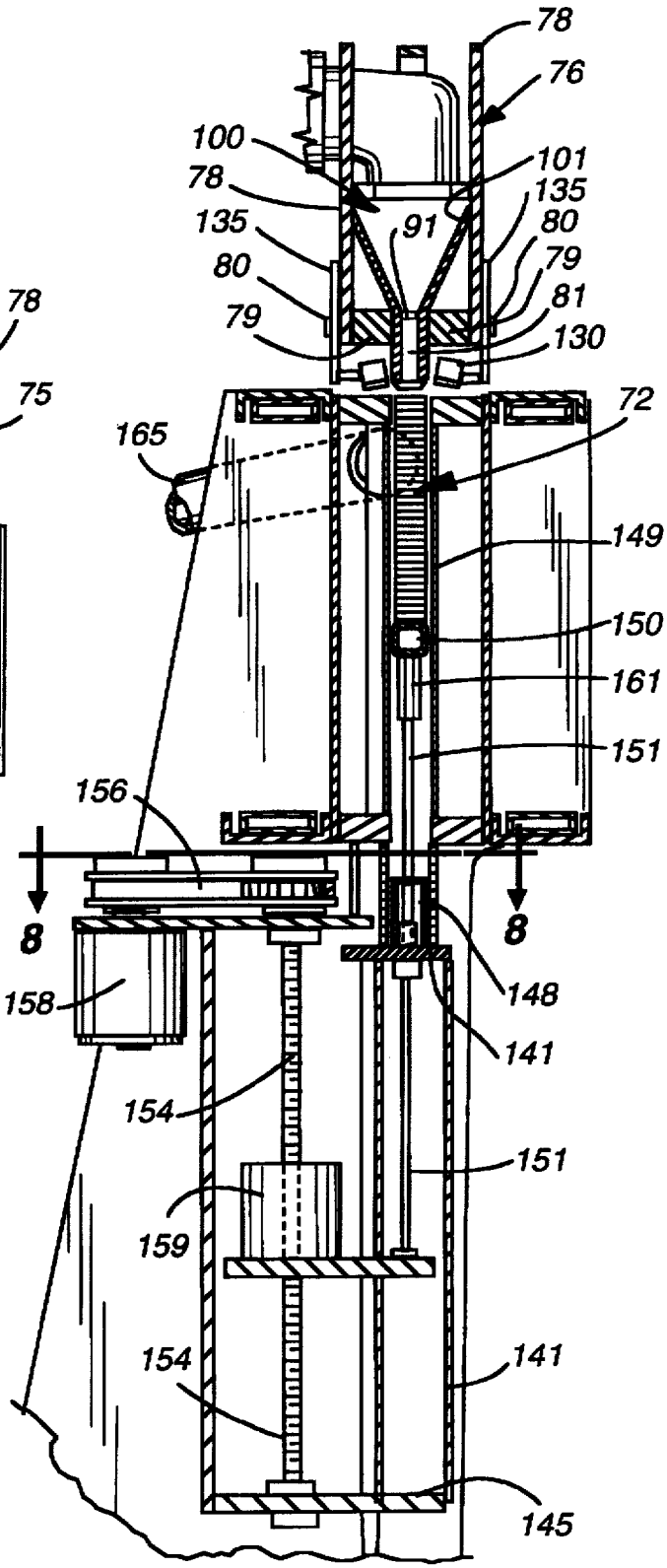
FIG. 6 is a cross-sectional view taken substantially in the plane of line 6—6 on FIG. 3.

Initially, the bar 150 is positioned in strip receiving position at the top of the fingers 149 by raising the index rods 151 (FIGS. 5, 6). As strips 71 are fed to and stacked on the stack bar 150, the bar is incrementally lowered, preferably by approximately 15/1000ths of an inch for each strip stacked on the stack. The index or increment of movement is determined by the indexing motor 158 which rotates the index screws 154 to lower the index rod support plate 162 and thus the index rods 151 as the stack is formed. The amount of index movement is determined by the dimensions and characteristics of the strip material being stacked.

For reducing flutter and misalignment of the strips 71 as they are inserted into the stack 72, a vacuum or negative air flow chamber 162 is provided on each side of the magazine 140. The vacuum chambers 162 are supported on the stacker frame base 142 adjacent to but below the conveyor 75, and define inwardly facing perforated walls 164 on either side of the magazine 140. A vacuum is pulled by one of the vacuum pumps 83 through an appropriate vacuum line conduit 165. The vacuum on the lateral chambers is continuous and is not interrupted by the air pulses utilized to direct the strips into the stack. The lateral vacuum chambers thus create a negative pressure which induces a stabilizing air flow around the sides of the stack.

A stack level or count sensor 166 mounted on the stacker frame 76 adjacent the stack magazine senses the level of strips in the stack and signals the controls 53 to terminate stacking when the desired stack height is achieved. At the same time, the stacker stepper or index motor 158, is activated as each strip is inserted into the stack. The foregoing operations can be effected by a microprocessor driven controller 170 which controls the various sensors and motors, both to sense defects, count strips, and activate the air discharge valves.

Figure 21:
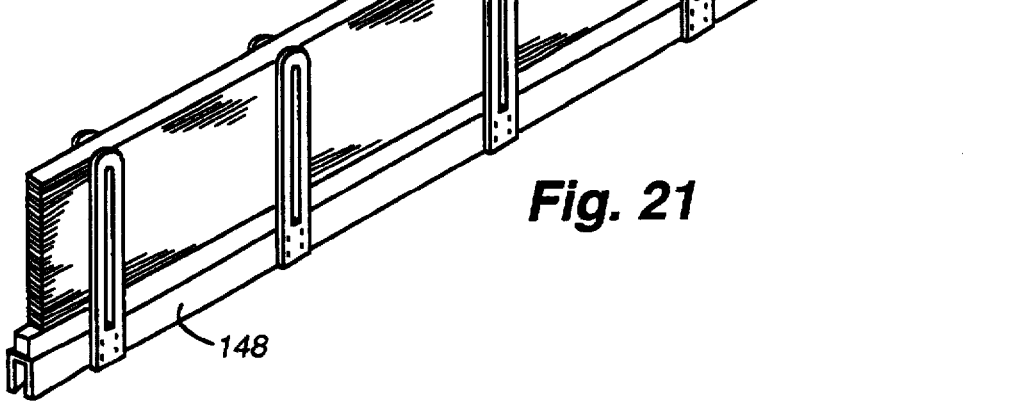
FIG. 21 is an enlarged isometric view of a portion of the strip stacker portion shown in FIG. 20 with a stack of strips therein.
Figure 22:
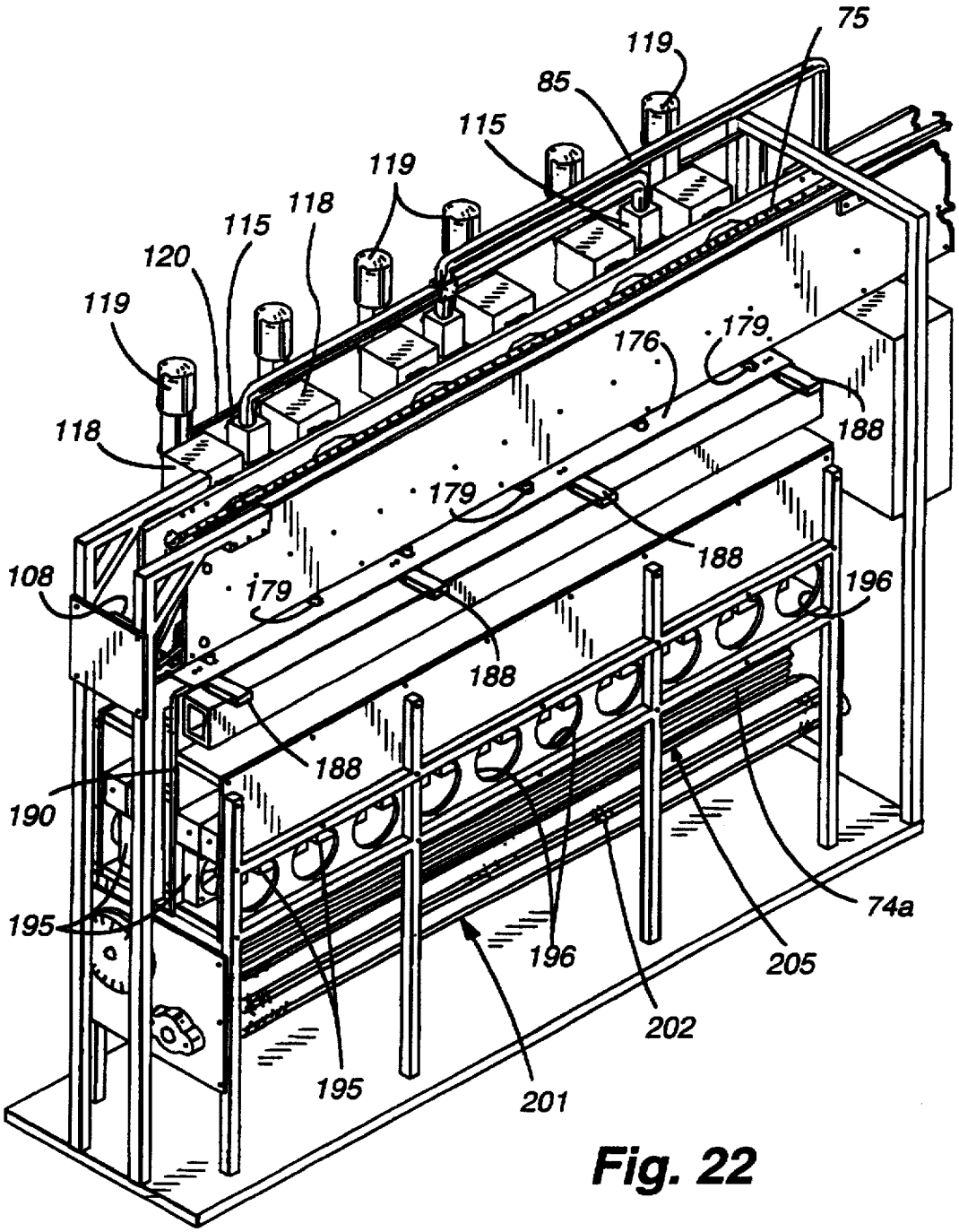
FIG. 22 is an enlarged partial front perspective view of a modified form of the strip stacker embodying the present invention.
Figure 23:
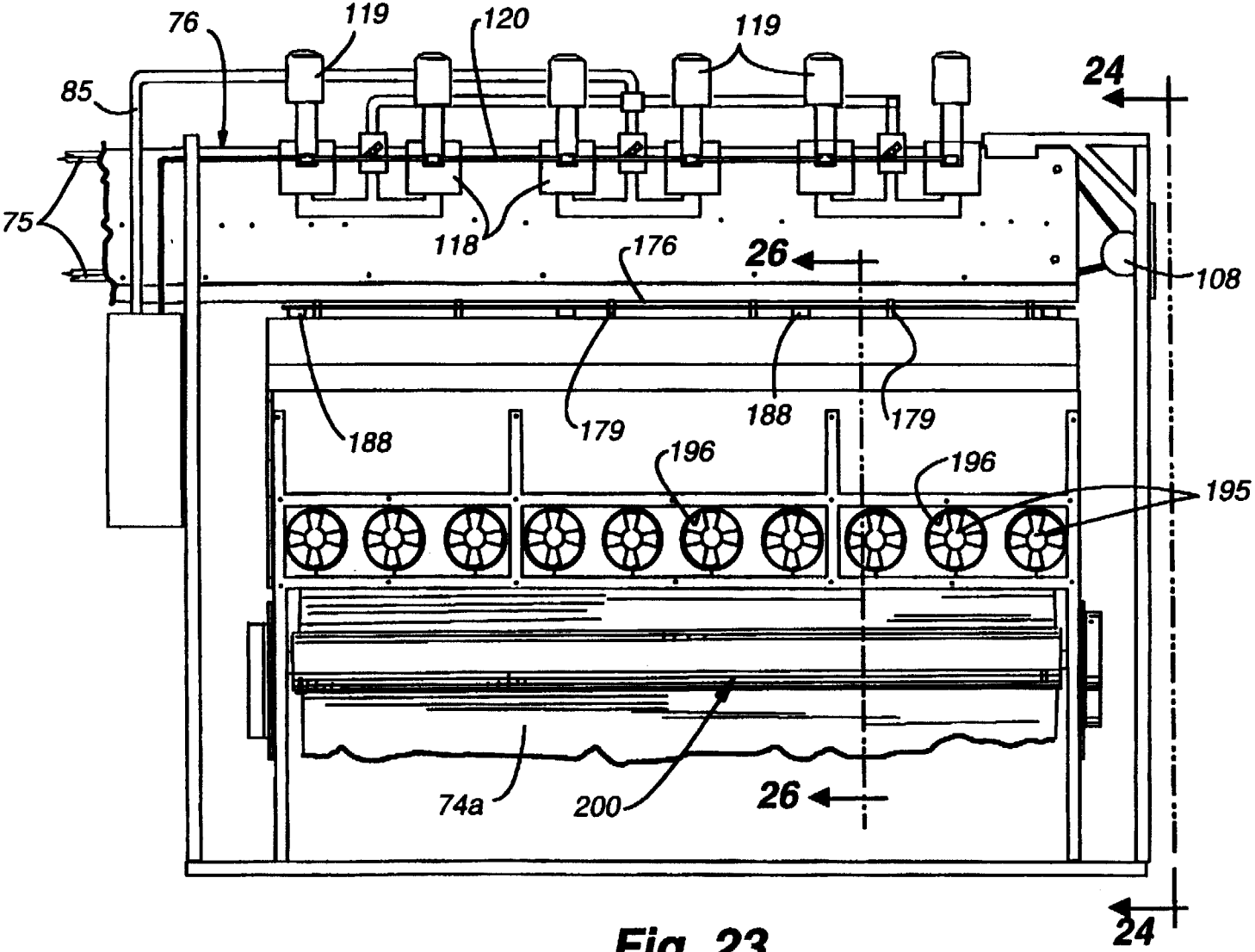
FIG. 23 is a rear elevational view of the strip stacker shown in FIG. 22.

When a stack of strips is completed, as shown in FIG. 21, the magazine 140 is removed by lowering the support frame housing using the support frame motors 144. When lowered, the magazine 140 can be lifted from the support frame housing 141 and removed and replaced by an empty magazine for receiving cut strips to form a new stack. The empty magazine 140 and stack bar 150, when positioned in place on the support frame housing 141, are raised upwardly into position beneath the strip conveyor by the support frame motors 144. The stack bar 150 is raised to its topmost position by the indexing rods 151 and motor 158. As strips are stacked on the stack bar 150, the bar 150 is incrementally lowered until the magazine 140 is full. The operation of loading and emptying the magazine is repeated to produce a plurality of cellular panels. After stacking, the stack 72 of strips 71 may be sent to a curing oven where the adhesive between the strip layers is cured to provide a completed panel.

In the event the defect sensor or scanner 127 senses a cut strip 71 with a defect, a control circuit is activated to disable the air discharge system by deactivating the air valves so that the defective cut strip passes through the apparatus and out the discharge end thereof without being directed into the stack, and the defect sensor reactivated for the next cut strip. The number of defects may be counted by a defect counter forming a part of the control circuit.

The foregoing embodiment of the invention finds particular but not necessarily exclusive utility in stacking relatively stiff strips of folded material. Such materials exhibit sufficient stiffness to permit stacking without fluttering, wrinkling or buckling as a result of the discharge from the conveyor into the stacker and the air flow around the stack. A further and presently preferred embodiment of the present invention finds particular but not necessarily exclusive utility for stacking more flexible strips of softer materials. In describing this embodiment, reference characters similar to those used above will be employed where applicable for like elements with the distinguishing suffix "a".

As folded strips, which are soft and flexible, drop from the conveyor into the stacking magazine, such strips tend to flutter and buckle before dropping into contact with the next lower strip in the stack. This results in misalignments, wrinkles and other imperfections in the cellular structure formed from the strips resulting in the production of unsightly and defective panels.

Figure 26:
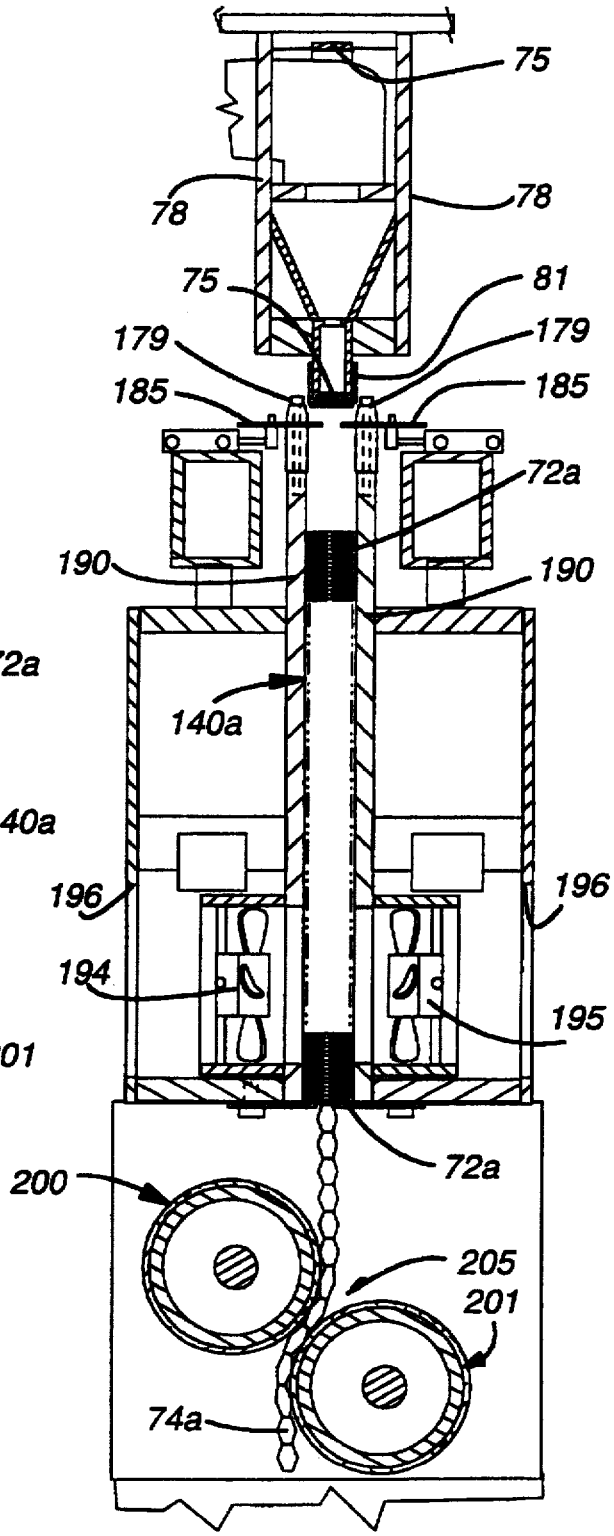
FIG. 26 is an enlarged cross-sectional view taken substantially in the plane of line 26—26 on FIG. 23.
Figure 25:
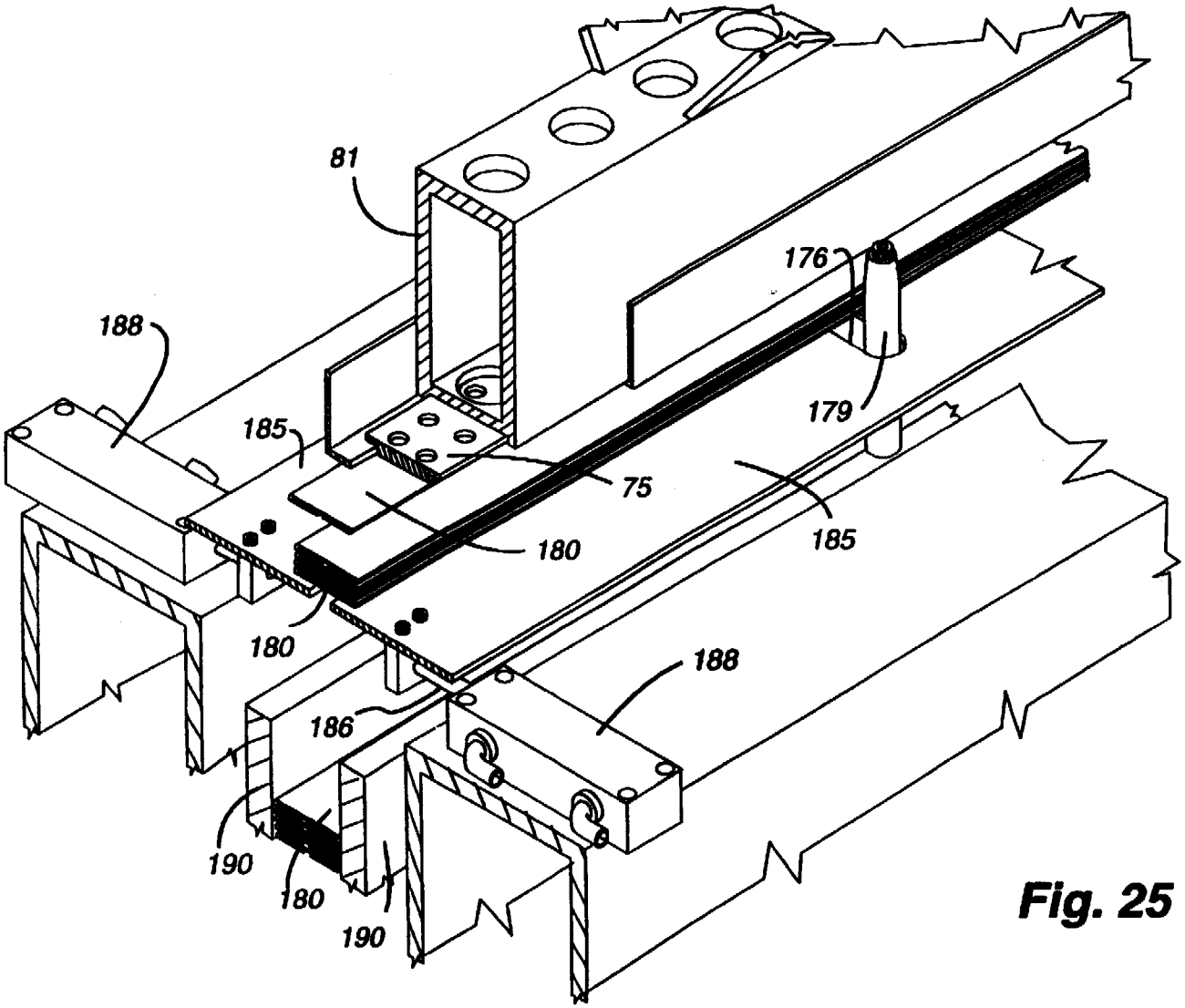
FIG. 25 is an enlarged isometric view of a portion of the strip stacker shown in FIG. 22.
Figure 27:
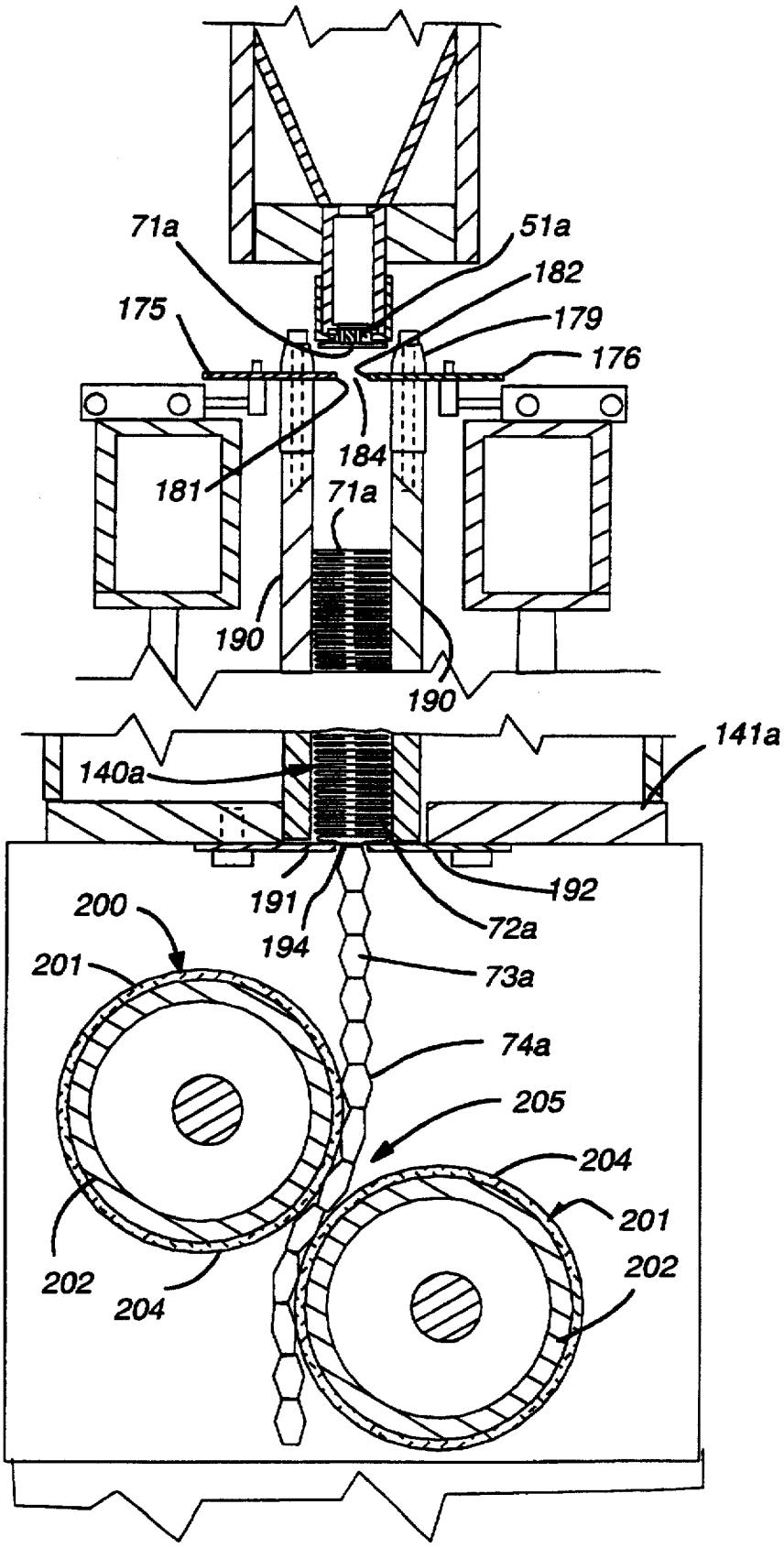
FIG. 27 is an enlargement of portions of the cross-sectional view shown in FIG. 26.
Figure 28:
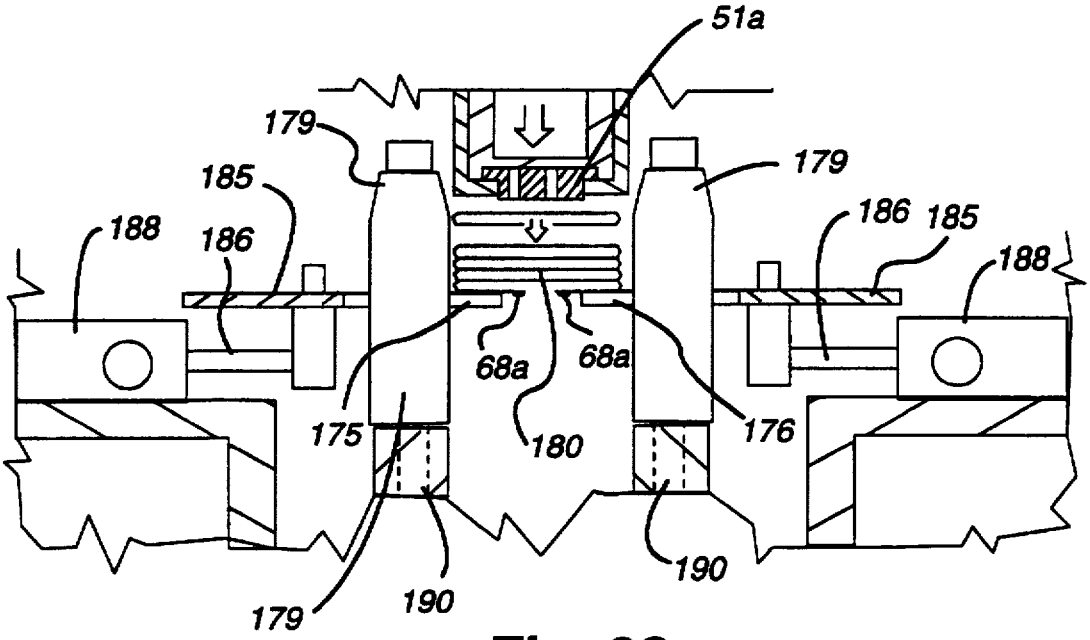
FIG. 28 is a further enlargement of the cross-sectional view shown in FIG. 27 illustrating a preliminary accumulation of cut strips.
Figure 29:
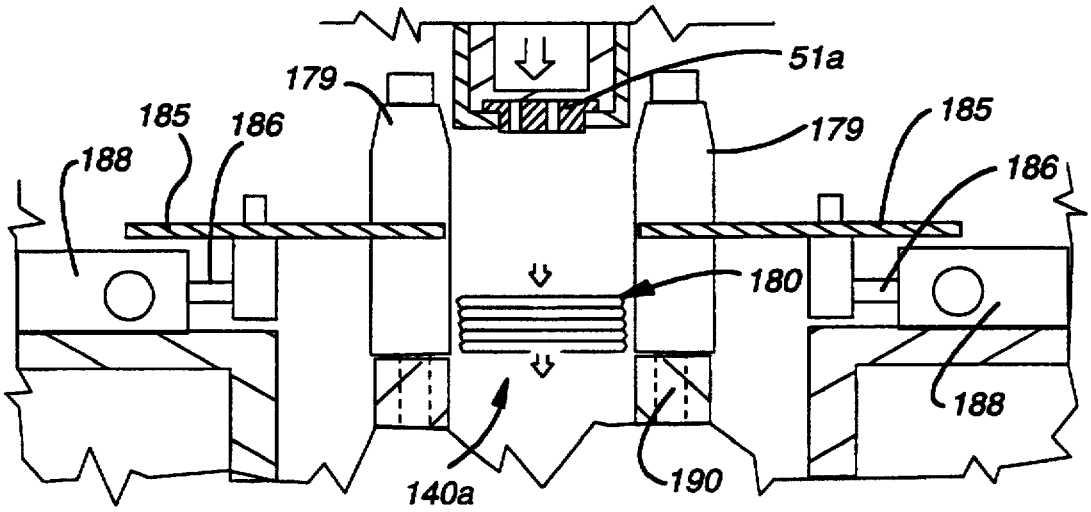
FIG. 29 is a view similar to FIG. 28 but showing the discharge of accumulated strips into the strip magazine.

To alleviate the fluttering and resultant wrinkling, a preferred embodiment of the present invention is shown in FIGS. 22–29, and stacks the folded, soft, flexible strips **71*a* on shuttle plates 175, 176 in an auxiliary magazine 178 defined by upstanding strip guide posts 179 to form a small stack 180 of about five strips 71*a* (FIG. 28) which are then dropped as a group onto a stack 72*a* of cellular strips in the principal magazine 140*a* (Fig. 27). To this end, the shuttle plates 175, 176 open by transversely sliding apart thereby allowing the bundle 180 of strips 71*a* to drop into the magazine 140*a***.

The number of strips in the auxiliary stacker 180 may be determined by the counter sensor 166 which effects actuation of the shuttle plate motors 188 when a preselected number of strips **71*a* are in the stack 180. For supporting the small or auxiliary bundle 180 of strips 71*a*, the shuttle plates 175, 176 extend generally longitudinally parallel to the conveyor 51*a* with opposed edges 181, 182 spaced apart to define a gap 184 over which the edges of the cell strip 71*a* bearing adhesive beads 68*a* are located. The shuttle plates 175, 176 are supported on a plurality of spaced mounting plates 185 in turn secured to piston rods 186 of air cylinder motors 188. By extending and retracting the rods 186, the plates 175, 176 are positioned in their closed position for receiving the cut strips 71*a* and opened by moving apart to allow the auxiliary stack 180 of cut strips 71*a* to drop into the magazine 140*a*. The air motors 188 actuating the shuttle plates 175, 176 are mounted on the frame or housing 141*a* of the stacker 50*a* in any appropriate manner, and are controlled by appropriate controls for actuation by a pressure fluid such as compressed air. The operation of the conveyor is as described above. Likewise, the structure and operation of the magazine can be as described above, or alternatively, a pair of fixed spaced apart magazine plates 190 can be provided with a mechanism for continuously withdrawing the formed cellular panel 74***a*, composed of cells 73*a*, from the bottom of the stack 72*a* of strips 71*a* in the magazine 140*a*.

Figure 24:
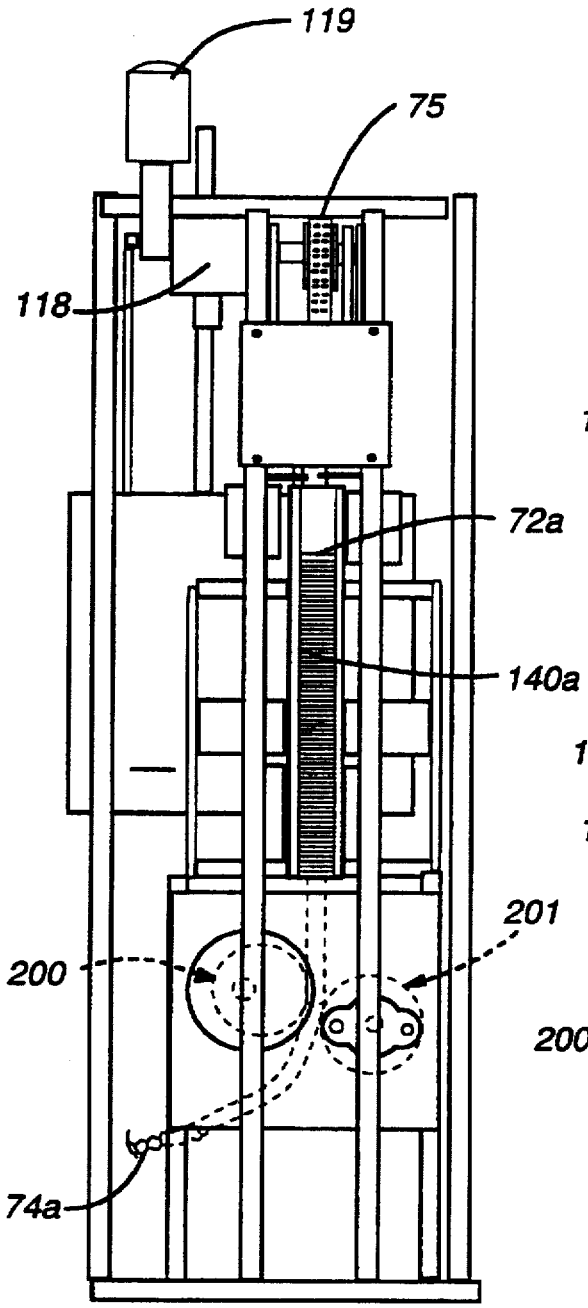
FIG. 24 is an end elevational view of the strip stacker shown in FIG. 22.

To the latter end, the magazine plates 190 are fixed on the stacker frame base 142*a* with an open bottom end partially closed by a pair of spaced orifice plates 191, 192 defining an elongated orifice slot 194 through which the cellular panel structure 74*a* can be pulled, as shown in FIGS. 24, 26 and 27.

For directing the cellular strips 71*a* into the magazine, a plurality of fans 195 (FIG. 23) are provided on the magazine plates 190 to produce a negative air flow through the magazine. The fans 195 are mounted in fan openings 196 defined in the magazine plates 190 near the bottom portion thereof.

For pulling the cellular structure from the magazine, a pair of spaced draw rollers 200, 201 are provided, each having an appropriate soft flexible lining 202 and fabric covering 204 thereon for gripping but not crushing the cellular panel structure 74*a*, as shown in FIGS. 26 and 27. For this purpose the rollers 200, 201 may be slightly offset to provide a nip or gap 205 through which the cellular structure is drawn.

When the cellular structure is withdrawn from the bottom of the magazine, the magazine plates or walls 190 are desirably heated to facilitate cure of the cellular strip adhesive. Appropriate heaters 206 are mounted on the wall plates 190 to maintain the plates 190 and the space between them at the desired curing temperature.

The nip 205 of the rollers 200, 201 may be adjustable by providing adjustable journal mountings (not shown) for the rollers at each end thereof. Likewise the orifice and magazine plate spacings may be adjustable. Further, the height of the auxiliary stack may be adjusted by raising or lowering the shuttle plates relative to the conveyor, or by providing a selected count of strips therein.

Where stiffer and less flexible cellular strips 71*a* are assembled, the shuttle plates 175, 176 may be blocked open allowing the strips 71*a* to drop directly into the stack 72*a* in the magazine. After being pulled from the magazine by the feed rollers, the cellular structure may be cut into any appropriate desired length by a suitable cutter mechanism or knife (not shown).

While a certain illustrative form of the present invention has been disclosed in the drawings and described above in considerable detail, it should be understood that there is no intention to limit the invention to the specific form disclosed. On the contrary, the intention is to cover all modifications, alternative constructions, equivalents, and uses falling within the spirit and scope of the invention.

We claim:

1. A conveyor for conveying a cut elongated flexible strip while supporting said strip over its length and width comprising, in combination, a support frame, a moving foraminous conveyor belt mounted on said frame for receiving and supporting said strip over its length and width and conveying said strip to a discharge point, a vacuum source, a housing on said frame defining a suction chamber in communication with said vacuum source, and a track on said housing guiding said belt adjacent to suction chamber and means for capturing said belt within said track adjacent to said suction chamber said track and said means for capturing preventing displacement of said belt from said suction chamber and retain said belt in communication with said suction chamber whereby said strip is retained on said conveyor belt by suction.

2. A conveyor for conveying a flexible material comprising, in combination, a support frame, a continuous moving foraminous belt having opposite faces mounted on said support frame, a vacuum source, a housing on said frame defining a suction chamber in communication with said vacuum source, said housing defining a channel in communication with said chamber for receiving and guiding said belt such that one of said faces confronts said suction chamber, and brackets overlying said channel and the other of said faces so as to capture said belt between the brackets and the suction chamber and retain said belt in said channel, said belt retaining and conveying the flexible material by the application of suction thereto.

3. A conveyor for conveying and discharging cut elongated strips of flexible material comprising, in combination, a support frame, a moving foraminous conveyor belt mounted on said support frame, a housing on said frame defining a suction chamber, a source of vacuum connected to said chamber for producing said suction, said housing further defining a track for receiving said conveyor belt and exposing said belt to said suction, said belt retaining the strips thereon by applying a suction thereto and conveying retained strips to a discharge position, and a source of pressurized air connected to said chamber for applying a burst of air under pressure thereto to override said suction and eject conveyed strips from said conveyor belt.

4. The conveyor of claim 3 further including a manifold and a pressurized air chamber connected for fluid communication with said manifold, said manifold being connected for fluid communication with said suction chamber whereby pressurized air can be supplied to said suction chamber.

5. The conveyor of claim 4 wherein there are a plurality of pressurized air chambers which are connected for fluid communication with said suction chamber.

6. The conveyor of claim 5 further including a central compressed air system and wherein said pressurized air chambers are connected for fluid communication with said central compressed air system.

7. The conveyor of claim 6 wherein there are first and second suction chambers and said manifold is only connected for fluid communication with said second suction chamber.

8. The conveyor of claim 3 wherein said strips further include lines of adhesive.

9. The convey of claim 8 wherein said strips have an upper surface and a lower surface and wherein said upper surface is engaged with said conveyor belt.

10. The conveyor of claim 9 wherein said lines of adhesive are on said lower surface of said strips.

11. The conveyor of claim 3 wherein said strips include at least one fold line.

12. The convey of claim 11 wherein said fold line is a permanent crease.

13. The conveyor of claim 3 further including at least one static discharge element for discharging static electricity from said conveyor belt.

14. A conveyor for conveying strips of soft, flexible material comprising, in combination, an elongated support frame, a vacuum source mounted on said frame, a housing mounted on said frame and defining a suction chamber in communication with said vacuum source and a track in communication with said chamber, an idler pulley mounted on one end of said frame, a drive pulley mounted on the other end of said frame, a sprocket on said drive pulley, a drive motor mounted on said frame and having an output shaft, a sprocket on said output shaft, a drive belt operatively engaging and connecting said sprockets, and a continuous endless foraminous conveyor belt supported on said drive and idler pulleys and guided in said track, said drive motor driving said drive belt to drive said conveyor belt, and said housing applying suction to said driven conveyor belt for retaining and conveying the strips to a discharge position.

15. A conveyor for conveying strips of soft flexible material comprising, in combination, an elongated support frame, a vacuum source mounted on said frame, a housing mounted on said frame and defining a suction chamber in communication with said vacuum source and a track in communication with said chamber, an idler pulley mounted on one end of said frame, a drive pulley mounted on the other end of said frame, a sprocket on said drive pulley, a drive motor mounted on said frame and having an output shaft, a sprocket on said output shaft, a drive belt operatively engaging and connecting said sprockets, and a continuous endless foraminous conveyor belt supported on said drive and idler pulleys and guided in said track, said drive motor driving said drive belt to drive said conveyor belt, said housing applying suction to said driven conveyor belt for retaining and conveying the strips to a discharge position, and a source of pressurized air connected to said chamber for applying a burst of air under pressure thereto to override said suction and eject the strips from said conveyor belt.

16. A conveyor as defined in claim 15 further comprising a static electricity discharge element mounted on said frame in operative juxtaposition with said conveyor belt.

17. A conveyor as defined in claim 15 further comprising a defect scanner mounted on said frame in juxtaposition with conveyed strips.

18. A conveyor as defined in claim 15 further comprising a strip sensor mounted on said frame in juxtaposition with said conveyor for detecting the leading end of a conveyed strip.

19. A conveyor for conveying a cut elongated strip of material, while supporting said strip over its entire length and width, said conveyor comprising a support frame, a moving, continuous, foraminous conveyor belt mounted on said frame, said conveyor belt having an upper run and a lower run, a vacuum source, a suction chamber communicating with said vacuum source, and a track guiding said conveyor belt with its lower run in communication with said suction chamber and means for retaining said conveyor belt within said track with its lower run in communication with said suction chamber, whereby said strip is retained by suction beneath said lower run of said belt.

* * * * *

UNITED STATES PATENT AND TRADEMARK OFFICE

CERTIFICATE OF CORRECTION

PATENT NO. : 5,664,773
DATED : Sep. 9, 1997
INVENTOR(S) : Thomas E. Sevcik, et al.

It is certified that error appears in the above-identified patent and that said Letters Patent is hereby corrected as shown below:

| | |
|---|---|
| Col. 1, line 39 | U.S. Pat. No. 5,319,999 should be --U.S. Pat. No. 5,313,999-- |

Signed and Sealed this

Ninth Day of December, 1997

Bruce Lehman

*Attest:*

BRUCE LEHMAN

*Attesting Officer*

*Commissioner of Patents and Trademarks*